US005634344A

United States Patent [19]

Yamauchi

[11] Patent Number: 5,634,344

[45] Date of Patent: Jun. 3, 1997

[54] METHOD FOR PRODUCING ICE VESSEL AND APPARATUS THEREFOR

[76] Inventor: Keijiro Yamauchi, Kabushiki Kaisha Yamanouchi Seisakusho of 1-8-18, Katakura, Kanagawa-ku, Yokohama-shi, Kanagawa-ken, Japan

[21] Appl. No.: 515,474

[22] Filed: Aug. 15, 1995

[30] Foreign Application Priority Data

Sep. 30, 1994 [JP] Japan ..... 6-237792
Jun. 27, 1995 [JP] Japan ..... 7-161044

[51] Int. Cl.[6] ..... F25C 5/14

[52] U.S. Cl. ..... 62/75; 62/341; 264/28

[58] Field of Search ..... 62/341, 75; 264/28; 425/4.2

[56] References Cited

U.S. PATENT DOCUMENTS

| | | | |
|---|---|---|---|
| 530,526 | 12/1894 | Holden | 62/341 |
| 4,571,320 | 2/1986 | Walker | 425/139 |
| 4,686,076 | 8/1987 | Dromingny et al. | 425/444 |
| 4,755,128 | 7/1988 | Alexander et al. | 425/422 |
| 4,780,119 | 10/1988 | Brooke | 62/341 |
| 4,920,762 | 5/1990 | Beckstead et al. | 425/412 |
| 4,965,027 | 10/1990 | Takahashi | 264/28 |
| 5,069,044 | 12/1991 | Holum et al. | 62/341 |
| 5,372,492 | 12/1994 | Yamauchi | 425/139 |
| 5,419,138 | 5/1995 | Anderson et al. | 62/341 |

FOREIGN PATENT DOCUMENTS 6-194018 7/1994 Japan .

*Primary Examiner*—William E. Tapolcai
*Attorney, Agent, or Firm*—Quarles & Brady

[57] ABSTRACT

An apparatus or method for automatically producing ice vessels. A male die 21 is provided opposite to a female die 11. A bottom surface of the female die 11 is formed with a through-hole 15, in which is provided a reciprocating body 17. The body 17 is capable of being raised or lowered by cylinder 18. Above one side of the female die 11 is provided a chute box 31 having an outlet port 32 facing the female die 11. Above the other side of the female die 11 is provided carrier arms 41 movable toward or away from the female die 11. An ice pieces equalizer 28 is provided above the female die 11. Ice pieces I are accommodated into the female die 11 with the body 17 protruding from the bottom surface thereof. Then, the body 17 is lowered to form a sinking. After that, an ice vessel is molded by depressing the male die 21. The body 17 is raised again for removal of the molded ice vessel A. Owing to the equalizer 28, surplus amount of ice pieces in the female die 11 are removed prior to molding.

9 Claims, 21 Drawing Sheets

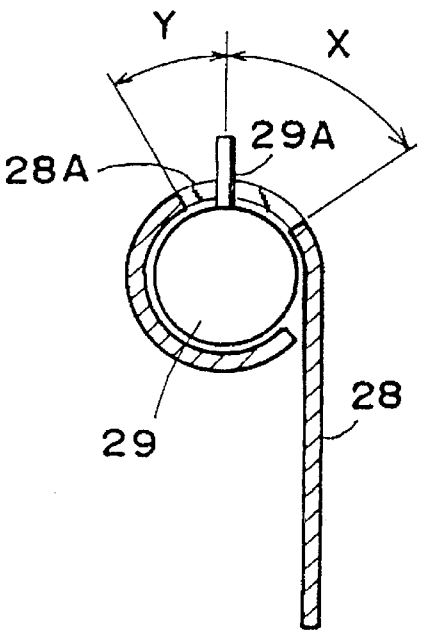
FIG. 6 (B)
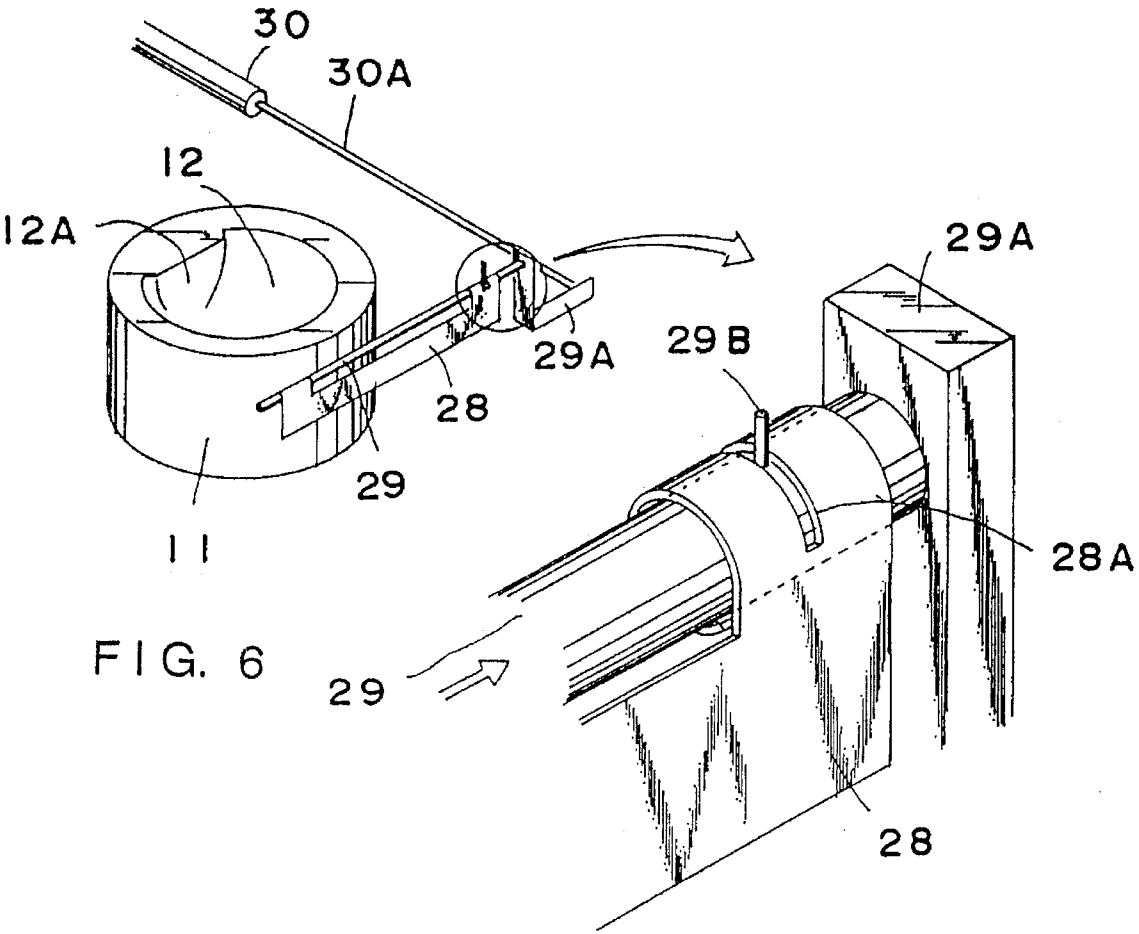
FIG. 6
FIG. 6 (A)

METHOD FOR PRODUCING ICE VESSEL AND APPARATUS THEREFOR

BACKGROUND OF THE INVENTION (a) Field of the Invention

The present invention relates to a method and apparatus for forming ice pieces into ice vessels for dishing up or covering food such as vegetable salad, sashimi or the like.

(b) Description of Prior Art

In the past, an apparatus for producing ice vessel for vegetable salad or the like has been proposed in Japanese Patent Application Un-Examined Publication No.6-194018, of which the columns 1 and 2 disclose an apparatus for producing ice vessels comprising a female die, a male die opposite to said female die for cooperating with said female die to define a mold cavity for forming said ice vessels, a through-hole formed at the bottom of said female die, a pushing-out pin which is raised and lowered in said through-hole by an elevator device, a chute box for feeding ice pieces from suitable ice crusher into said female die, said chute box having an outlet located above said female die and an inlet located below said ice crusher for receiving ice pieces therefrom, a carrier-arm device provided above said female die. The prior apparatus for producing ice vessels is operated in such a manner that relatively large masses of ice pieces fed from an ice making machine are crushed by the ice crusher and then supplied to the female die through the chute box, which are molded by the male die cooperating with the female die, so that molded ice vessels are taken out by the pushing-out pin raised by the elevator device, which are subsequently transported by the carrier arm device.

Such molded ice vessels are generally served for guests of a hotel or an inn, either with vegetable salad or sashimi accommodated therein to keep them cool or with such food dished up in a vessel in advance covered therewith.

According to the prior art, however, when ice pieces are fed from the chute into the female die, ice pieces have accumulated more thickly or heaped up in the center thereof than in the edge side thereof, which has sometimes caused molded ice vessel to be easily broken off at its edge side.

Further, according to the prior art, ice masses are ceaselessly supplied from the ice making machine to the ice crusher, which are subsequently crushed thereby to be yet ceaselessly fed into the female die. However, such production process of ice pieces cannot meet needs for constant ice volume required for producing one ice vessel, so that it has been difficult to supply ice pieces in proper quantities.

Furthermore, according to the prior art, as molded ice vessels have to be taken out one by one by means of the pushing-out pin, so that it cannot realize a mass production of ice vessels.

SUMMARY OF THE INVENTION

Accordingly, it is a main object of the present invention to provide a method for producing ice vessels which can mold a bowl-shaped ice vessel having a uniform thickness.

It is another object of the present invention to provide an apparatus for producing ice vessels which can mold an ice vessel having a uniform thickness.

It is also an object of the present invention to provide an apparatus for producing ice vessels which can make ice in proper quantities.

It is further an object of the present invention to provide an apparatus for producing ice vessels which can realize mass production of ice vessels.

In accordance with a major feature of the present invention, there is provided a method for producing ice vessel with the use of an apparatus for producing ice vessels comprising a female die, a male die opposite to said female die, a through-hole formed at the bottom of said female die, a reciprocating body which is raised or lowered in said through-hole by an elevator device, a chute box for feeding ice pieces from suitable ice crusher into said female die, a carrier-arm device provided above said female die, of which the steps comprising:

feeding ice pieces from the chute box into the female die with the reciprocating body being raised to protrude from a bottom surface of the female die;

pressing the male die to the female die to mold an ice vessel with the reciprocating body being lowered.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 6 illustrates an ice pieces equalizer of a first embodiment of the invention, of which FIG. 6(A) is a perspective view thereof, while FIG. 6(B) is a section thereof.

FIG. 7 is a section illustrating the first and second working processes in a first embodiment of the invention, of which FIG. 7(A) illustrates the first process, while FIG. 7(B) the second process.

FIG. 8 is a section illustrating the third and fourth working processes in a first embodiment of the invention, of which FIG. 8(A) illustrates the third process, while FIG. 8(B) the fourth process.

FIG. 9 is a section illustrating the fifth and sixth working processes in a first embodiment of the invention, of which FIG. 9(A) illustrates the fifth process, while FIG. 9(B) the sixth process.

DESCRIPTION OF PREFERRED EMBODIMENTS

Figure 1:
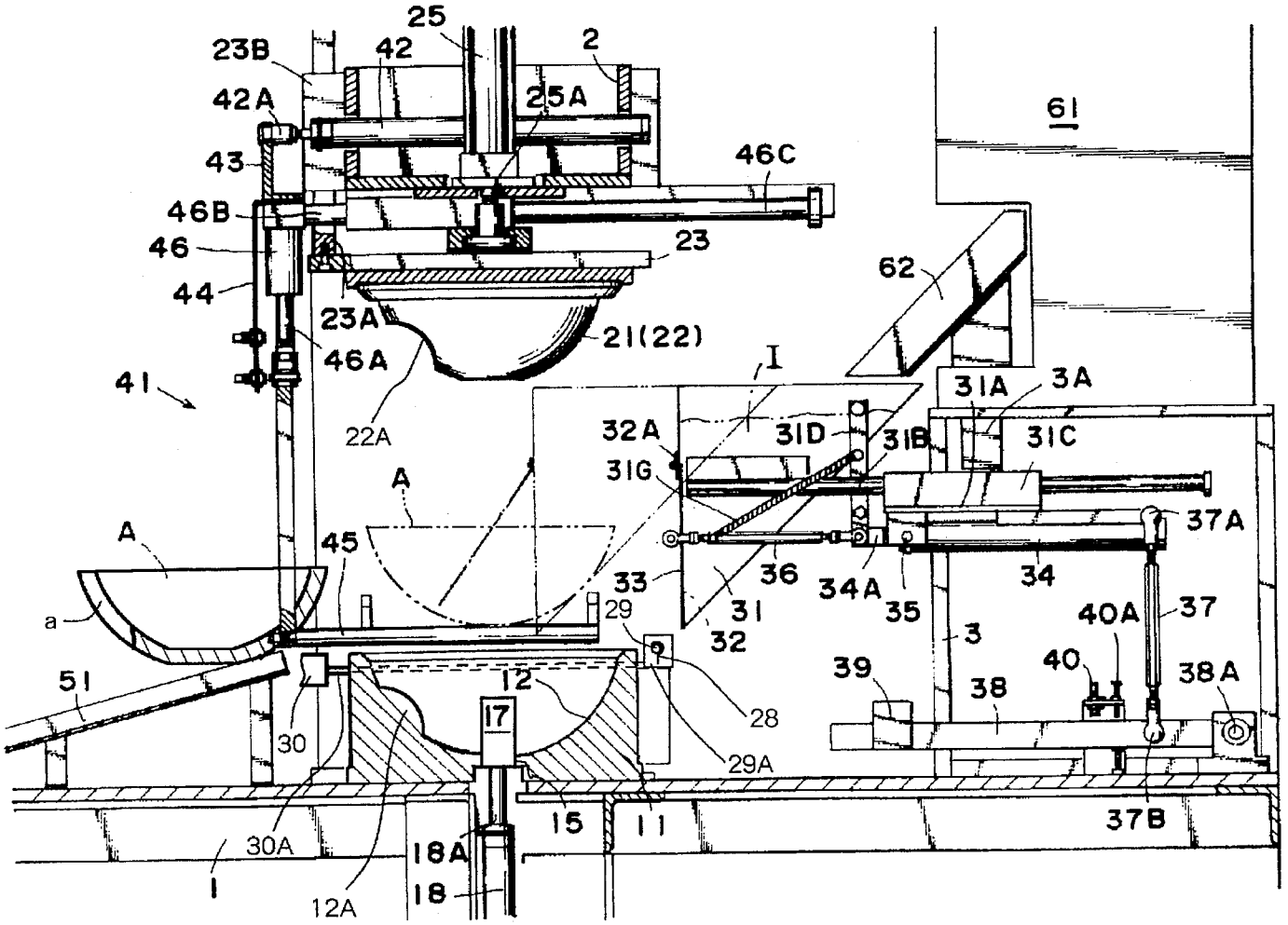
FIG. 1 is a section showing a first embodiment of the invention.

Hereinafter is described a first embodiment of the present invention with reference to FIGS. 1 to 12.

To base frame 1 is fixed female die 11, opposite to which is provided male die 21, which is vertically movable. At one side between elevated male die 21 and female die 11 is provided chute box 31 for feeding ice pieces I into the female die 11, while at its other side is provided carrier arm device 41 for transporting molded ice vessels. Adjacent the carrier arm device 41 is provided transporting chute 51.

An upper surface of the female die 11 is formed with semispherical concave portion 12 which is, for example, surface-treated with fluorine. The concave portion 12 is formed at one side with expansion 12A in order that window aperture "a" may be formed in an ice vessel A hereinbelow described. At the lowest part of the concave portion 12 is vertically provided through-hole 15, in which is provided cylindrical reciprocating body 17, having pneumatic cylinder device 18 therebelow as an elevator device with a distal end of rod 18A of the cylinder device 18 being connected to the body 17.

A lower surface of the male die 21 is formed with semispherical convex portion 22 which is, for example, surface-treated with fluorine as well. The convex portion 22 is formed at one side with recess 22A to be fitted into the expansion 12A. To an upper surface of the male die 21 is fixed flange 24 through mounting plate 23. Onto upper frame 2 provided above base 1 is secured pneumatic cylinder device 25 directed vertically downward, having rod 25A whose distal end is connected to flange 24. Thus, the actuation of the cylinder device 25 can allow the male die 21 to press toward the female die 11. The reference numeral 23A designates guiding rod for elevating motion, while 23B supporting casing for the rod 23A. The reference numeral 26 designates upper limit detection switch for male die 21, while 27 lower limit detection switch for female die 11.

Referring to FIGS. 1 and 6, ice pieces equalizer 28 sliding above the female die 11 is formed of stainless steel plate or the like which can slide across an entire surface of the semispherical concave portion 12, having its both upper ends connected to shaft 29, which is connected to rod 30A of pneumatic cylinder device 30 through connector 29A. The pneumatic cylinder 30 is provided at one side of the female die 11, while the ice pieces equalizer 28 is normally located at the other side thereof with the rod 30A being extended.

In the case of connecting the equalizer 28 with the shaft 29, there is provided a pin or stopper 29B extending from the shaft 29, while the equalizer 28 is formed with elongated hole 28A, thus rotatably anchoring the pin 29B by fitting the same into the hole 28A, whereby an lower end of the equalizer 28 can be rotated. In other words, in an approaching route where rod 30A is shrinked to move the equalizer 28 toward the above-mentioned one side, the lower end of the equalizer 28 can be inclined at an angle Y toward the above-mentioned other side, while in a return route where rod 30A is extended to move the equalizer 28 toward the other side, the lower end can be inclined at an angle X toward the one side (in the present case, Y>X)

The chute box 31 has an opening facing upward, and outlet port 32 vertically provided at its front side, said outlet port 32 being provided with gate plate 33 connected through hinge 32A at its upper portion, thus suitably opening or closing the port 32.

At a back side of the chute box 31, there is provided slide guide rod 31B which is slidable through support casing 31C fixed to slide plate 31A. The pneumatic cylinder device 34 is connected in such a manner that can slighly rotate around hinge shaft 35 secured to the slide plate 31A, while the gate plate 33 is rotatably connected to the rod 34A through forked rod 36. Supporting portion 31F, which is vertically fixed to the slide plate 31A has its upper part rotatably suspended through shaft 3B from support rod 3A of side frame 3. Reference numeral 31G designates a spring which connects rod 36 to connector rod 31D, said connector rod 31D being provided for connecting rod 34A to chute box 31. Thus, the extension of the rod 34A of the cylinder device 34 permits the gate plate 33 to open subsequently to an advance movement of the chute box 31.

Figure 2:
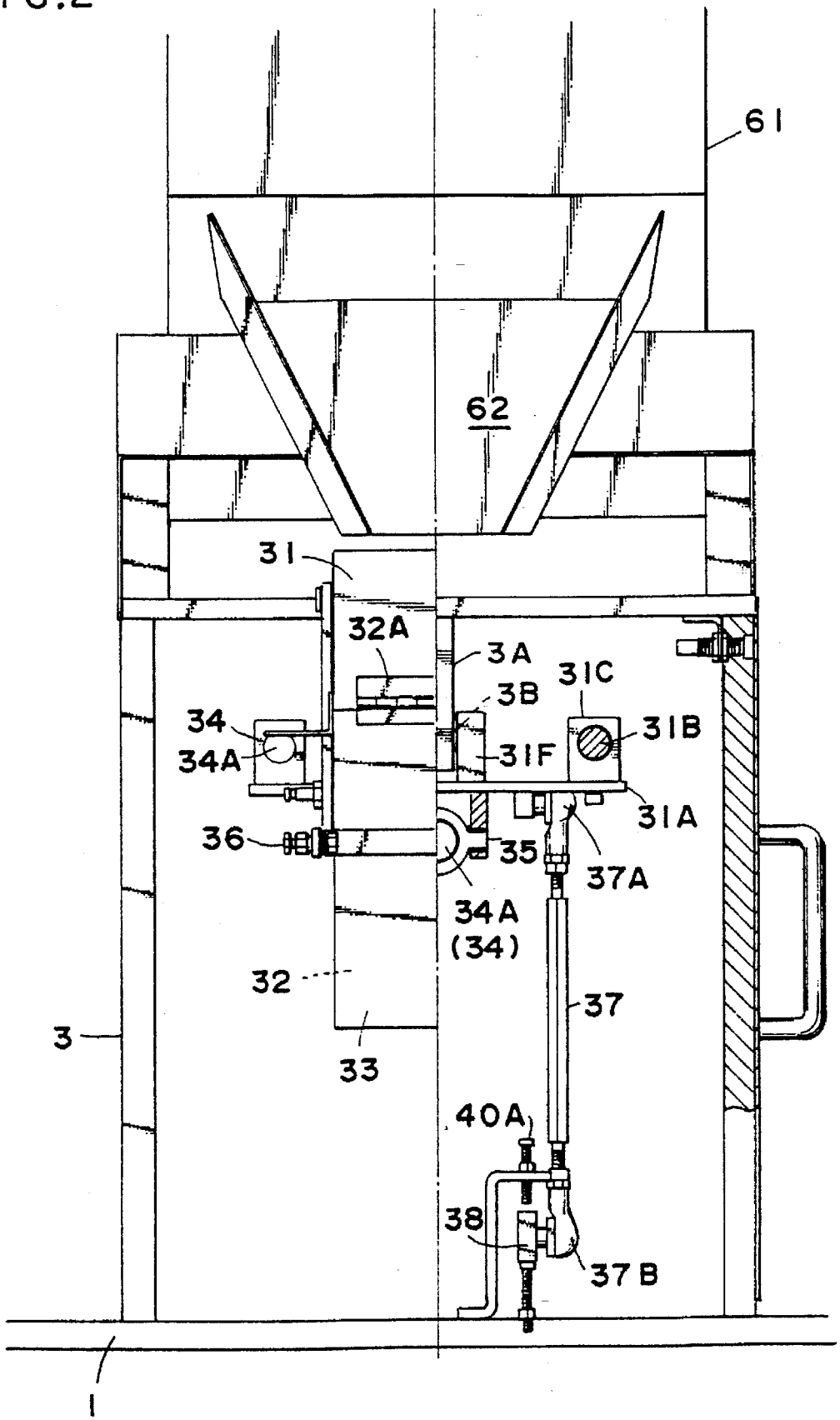
FIG. 2 is a partially cutaway side view showing a first embodiment of the invention.
Figure 3:
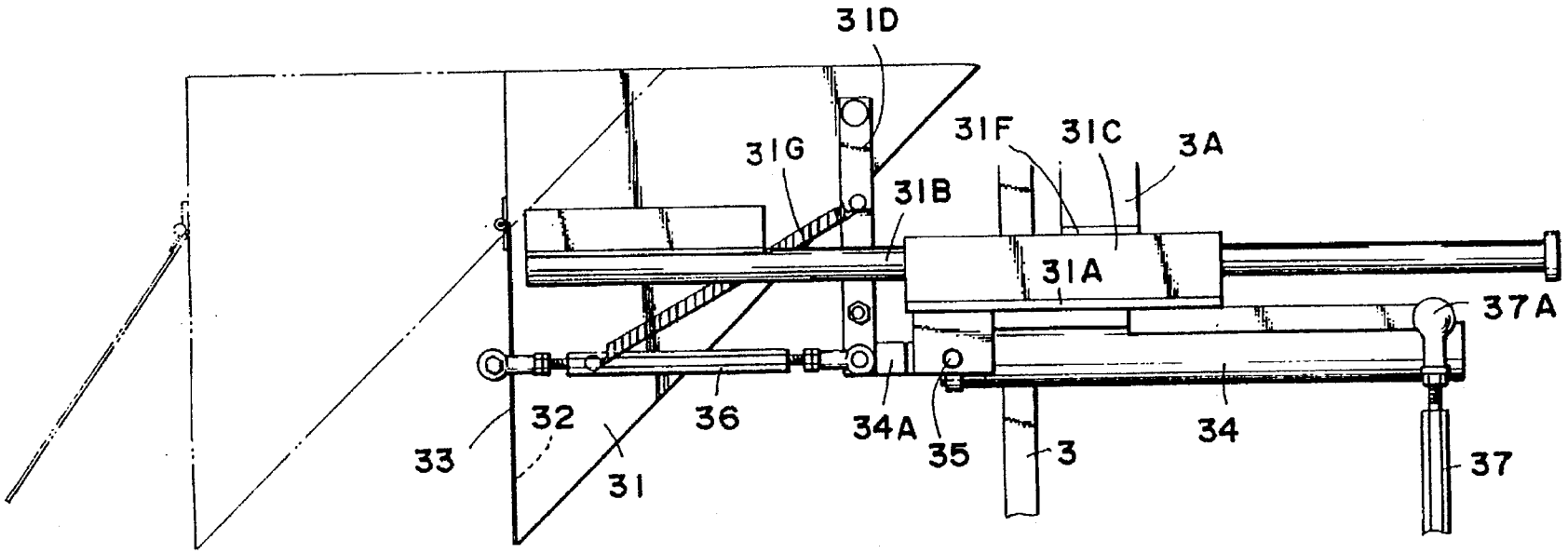
FIG. 3 is a side view showing a chute box of a first embodiment of the invention.

Referring to FIGS. 1 and 2, at a back side of the slide plate 31A, there is slidably provided upper end 37A of elevator rod 37, while lower end 37B thereof rotatably connected to lever 38, which has a fulcrum 38A at its proximal side and balance weight 39 slidably provided at its front. Reference numeral 40 designates switch 40, which is turned on by rotation of the lever 38, while 40A designates stopper for regulation of the rotation of the lever 38.

The carrier arm device 41 includes an air or pneumatic cylinder device 42 horizontally fixed to the upper frame 2. A movable frame 43 is provided at the end of rod 42A of the pneumatic cylinder device 42. Pendulous arms 44 have the upper ends rotatably connected to said movable frame 43. Holding arms 45 extending toward the female die 11 are respectively connected to the lower ends of the pendulous arms 44.

Figure 4:
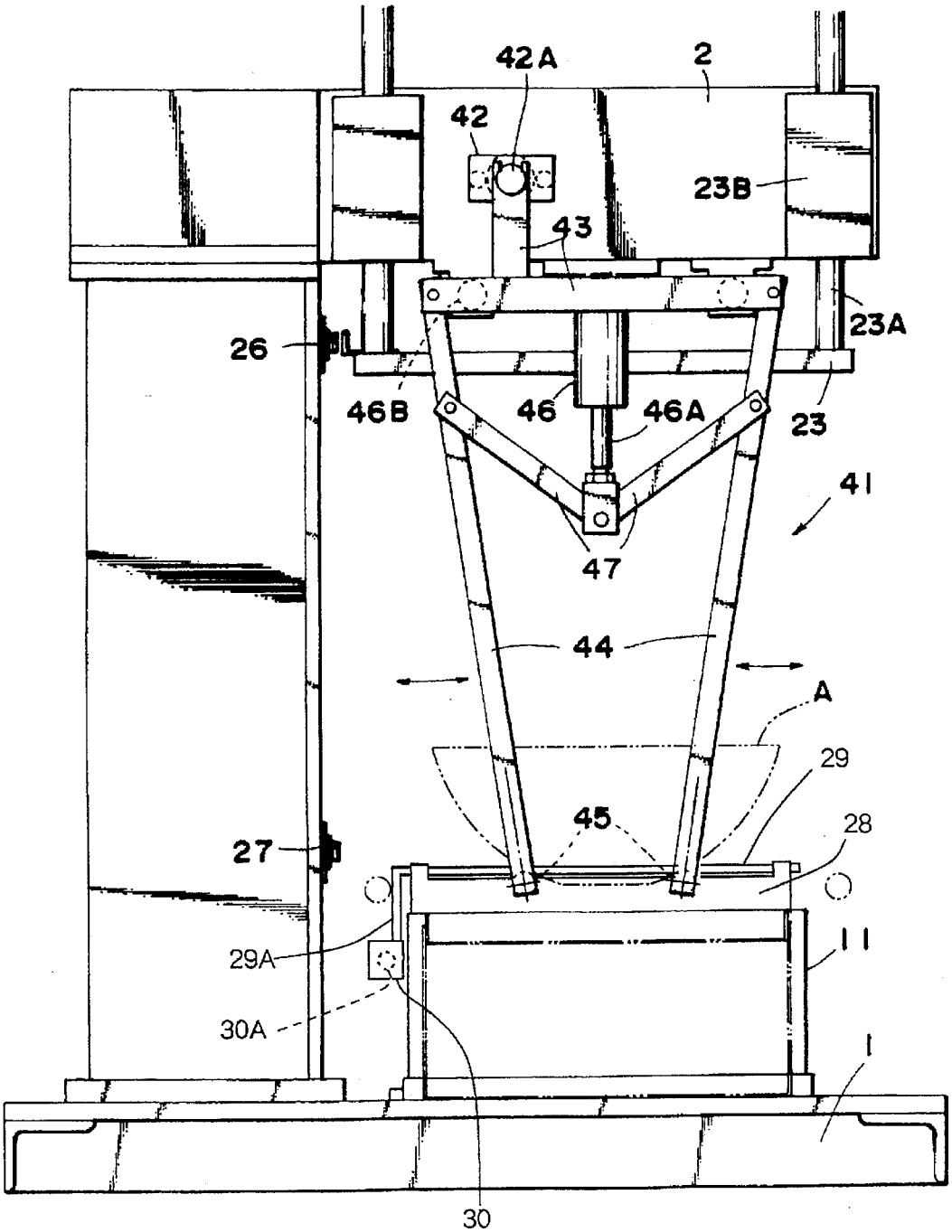
FIG. 4 is a side view showing a carrier-arm device of a first embodiment of the invention.
Figure 5:
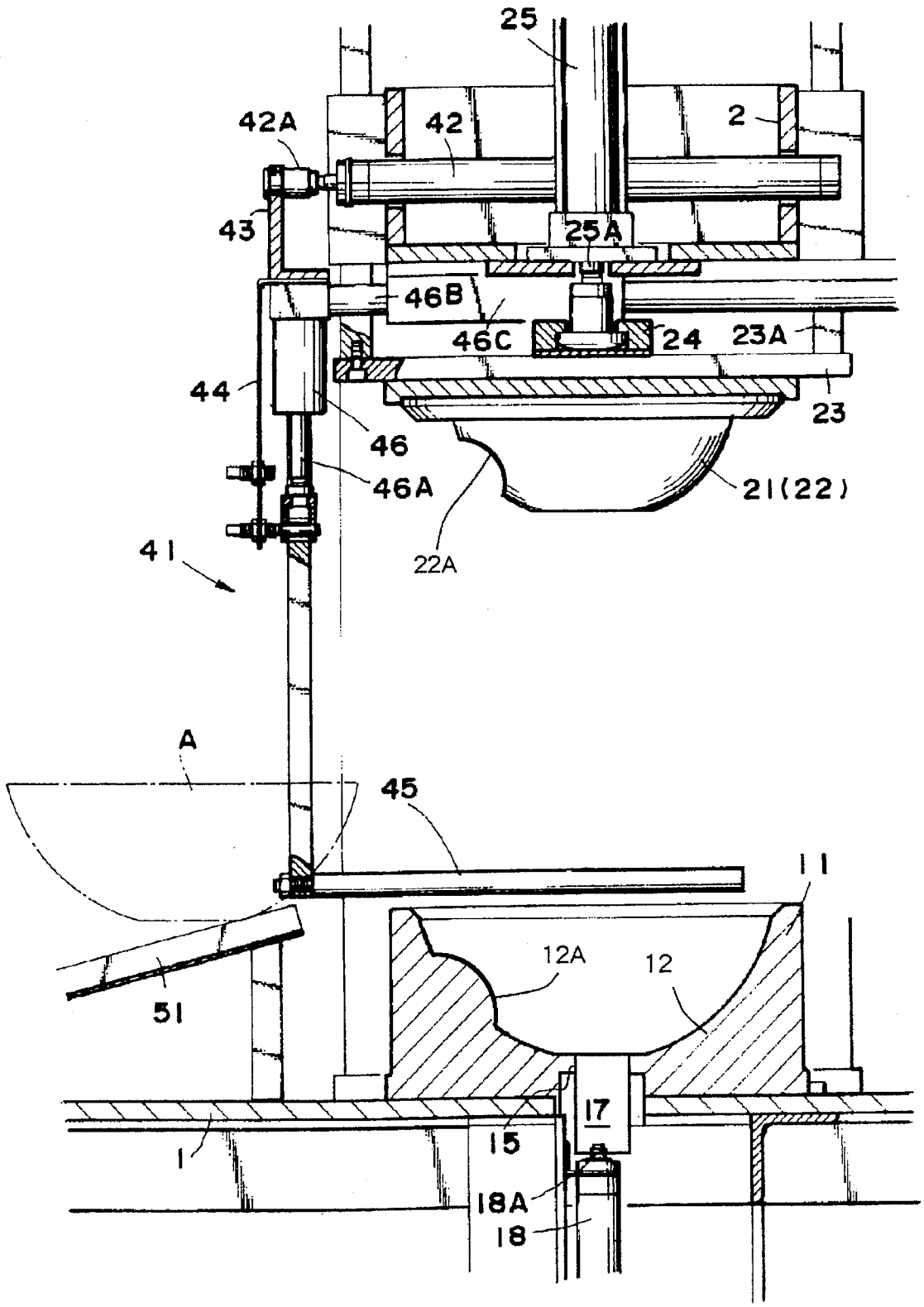
FIG. 5 is a section showing male and female dies of a first embodiment of the invention.
Figure 7:
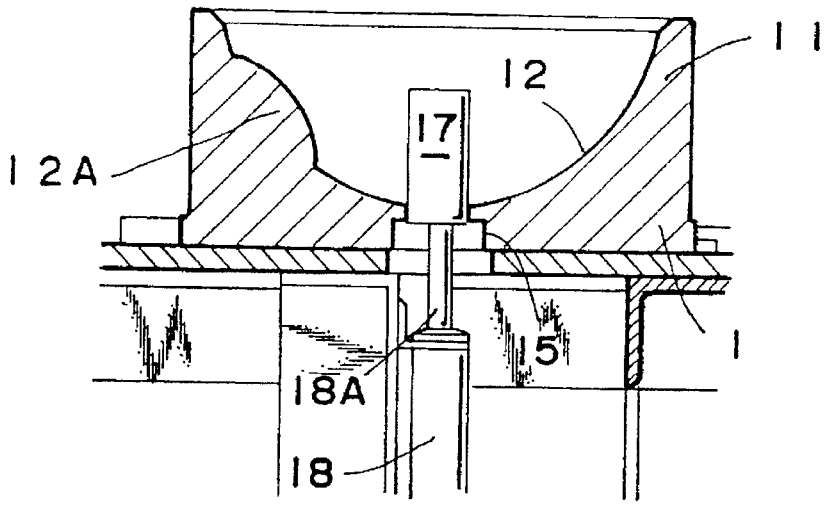
Figure 7:
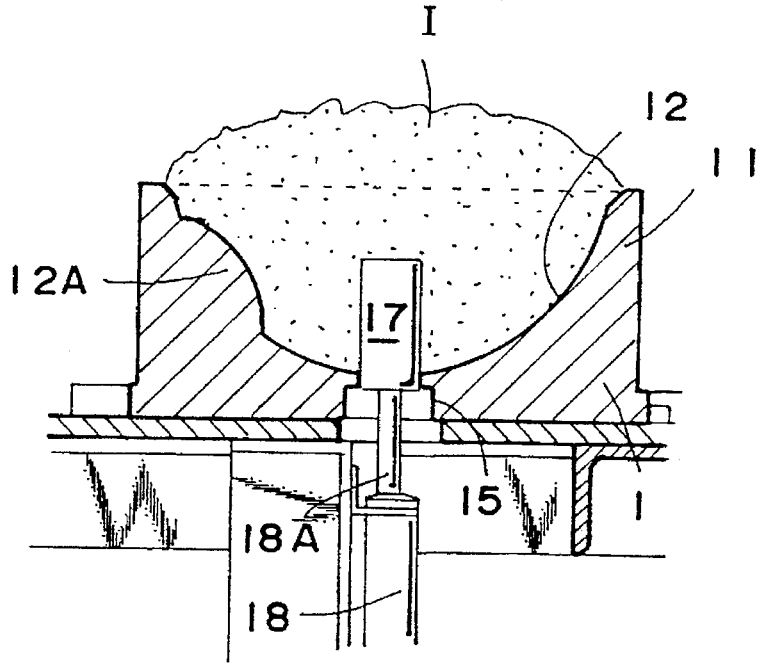
Figure 8:
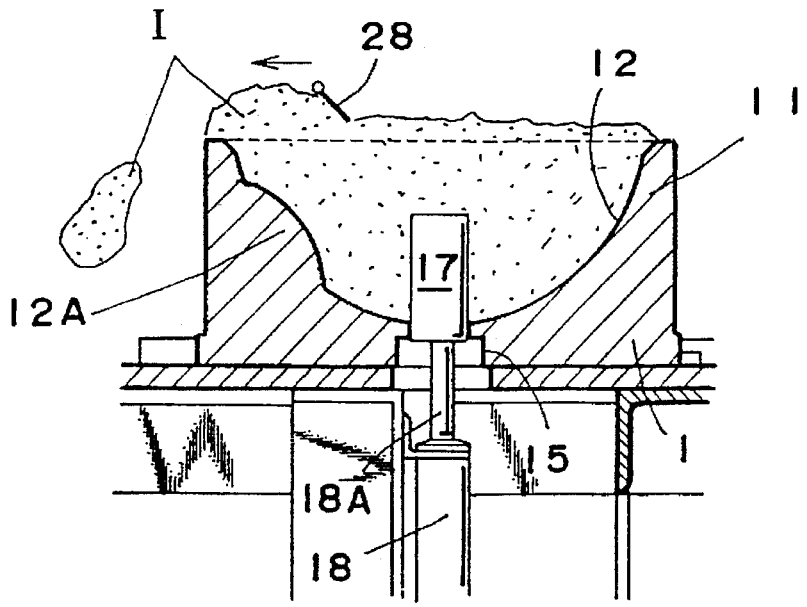
Figure 8:
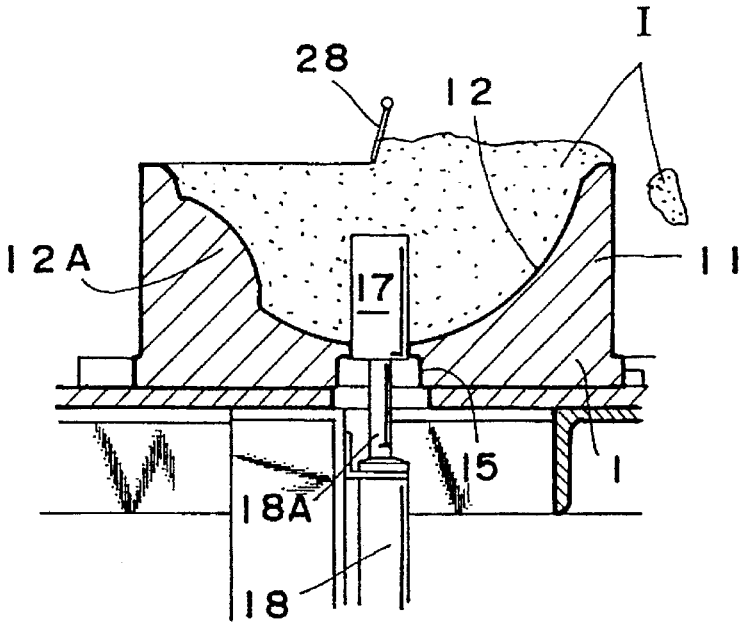

Referring to FIG. 4, in the center of the movable frame 43 is vertically mounted pneumatic cylinder device 46 to move the pendulous arms 44 toward or away from each other. To the rod 46A of the cylinder device 46 is rotatably connected one end of interlocking arms 47, while the other end of each arm 47 is rotatably connected to a respective pendulous arm 44.

Reference numeral 46B designates a slide guide rod, which is slidably supported by cylindrical support casing 46C fixed to the upper frame 2. Numeral 61 designates an automatic ice crusher mounted on side frame 3 for making ice pieces I, which can crush relatively great mass of ice, thus feeding the crushed ice pieces through outlet 62 to the upper aperture of the chute box 31.

Figure 11:
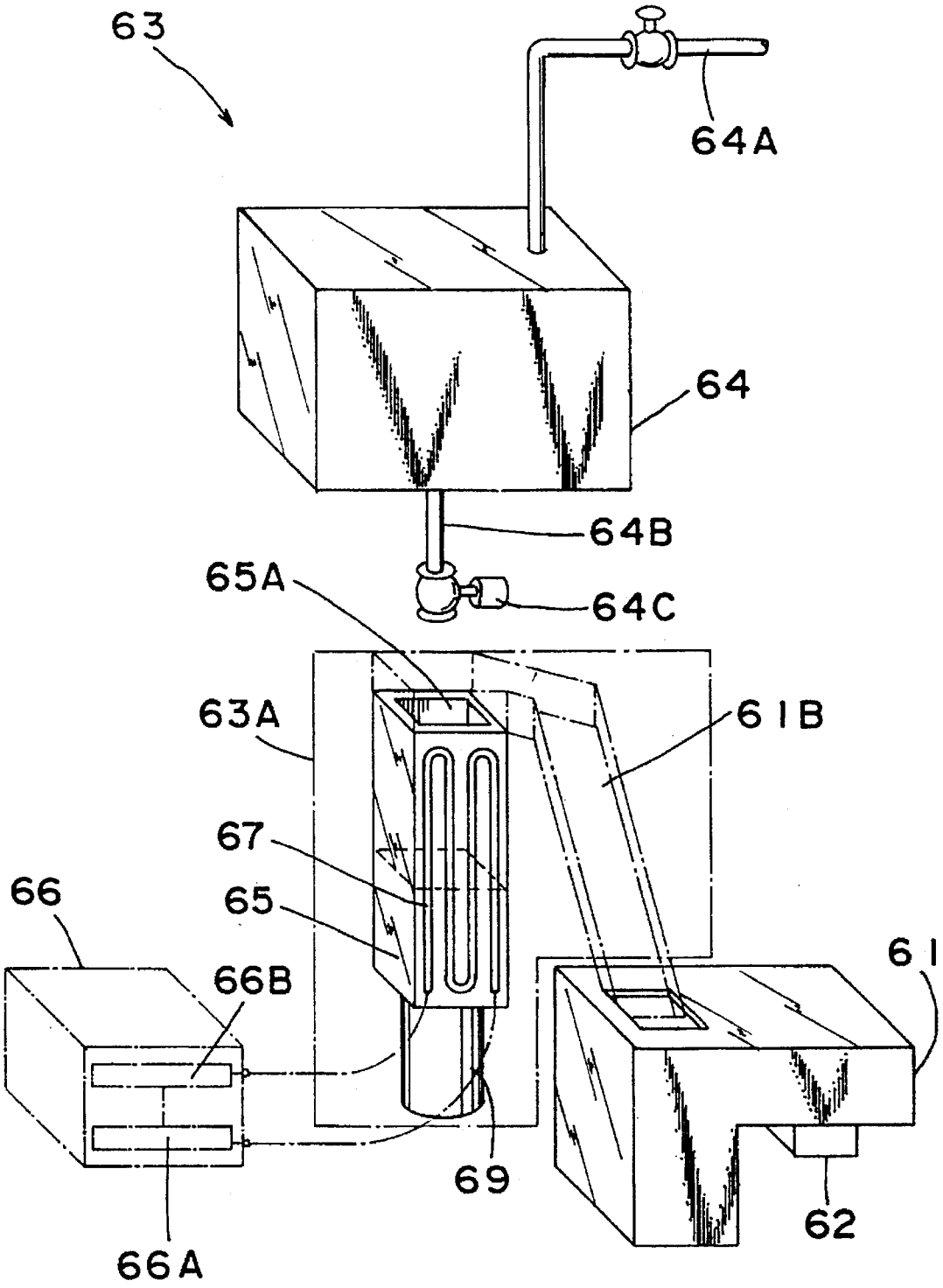
FIG. 11 is a perspective view showing an ice making machine of a first embodiment of the invention.
Figure 12:
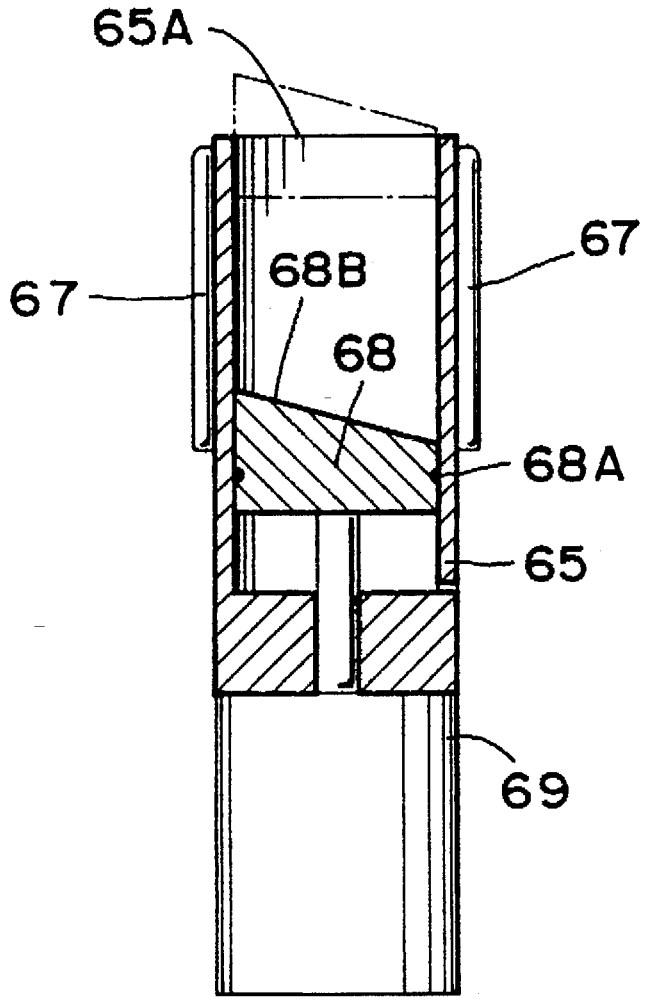
FIG. 12 is a section showing an ice making box of a first embodiment of the invention.
Figure 13:
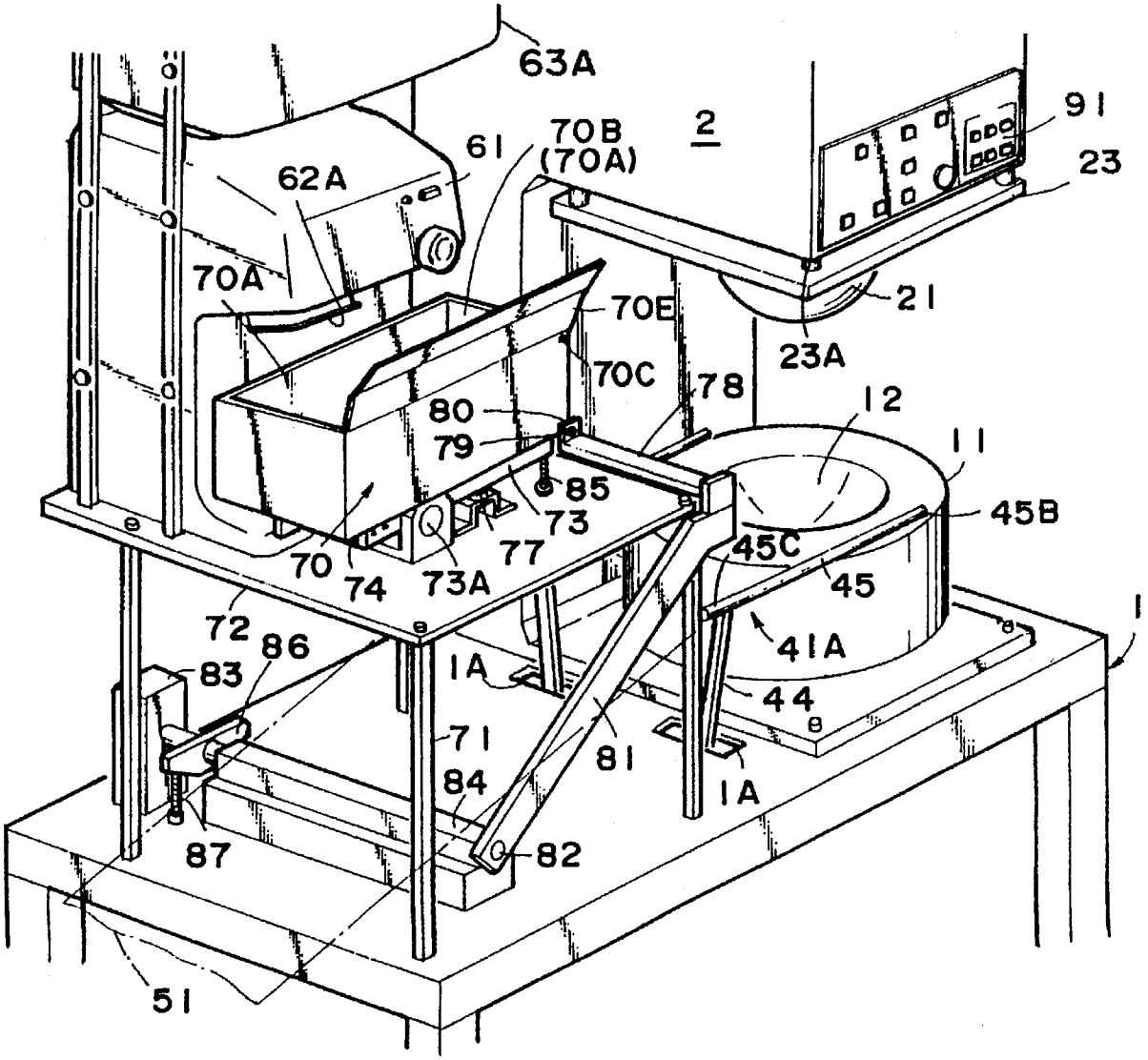
FIG. 13 is a perspective view showing a chute box in a horizontal state of a second embodiment of the invention.
Figure 14:
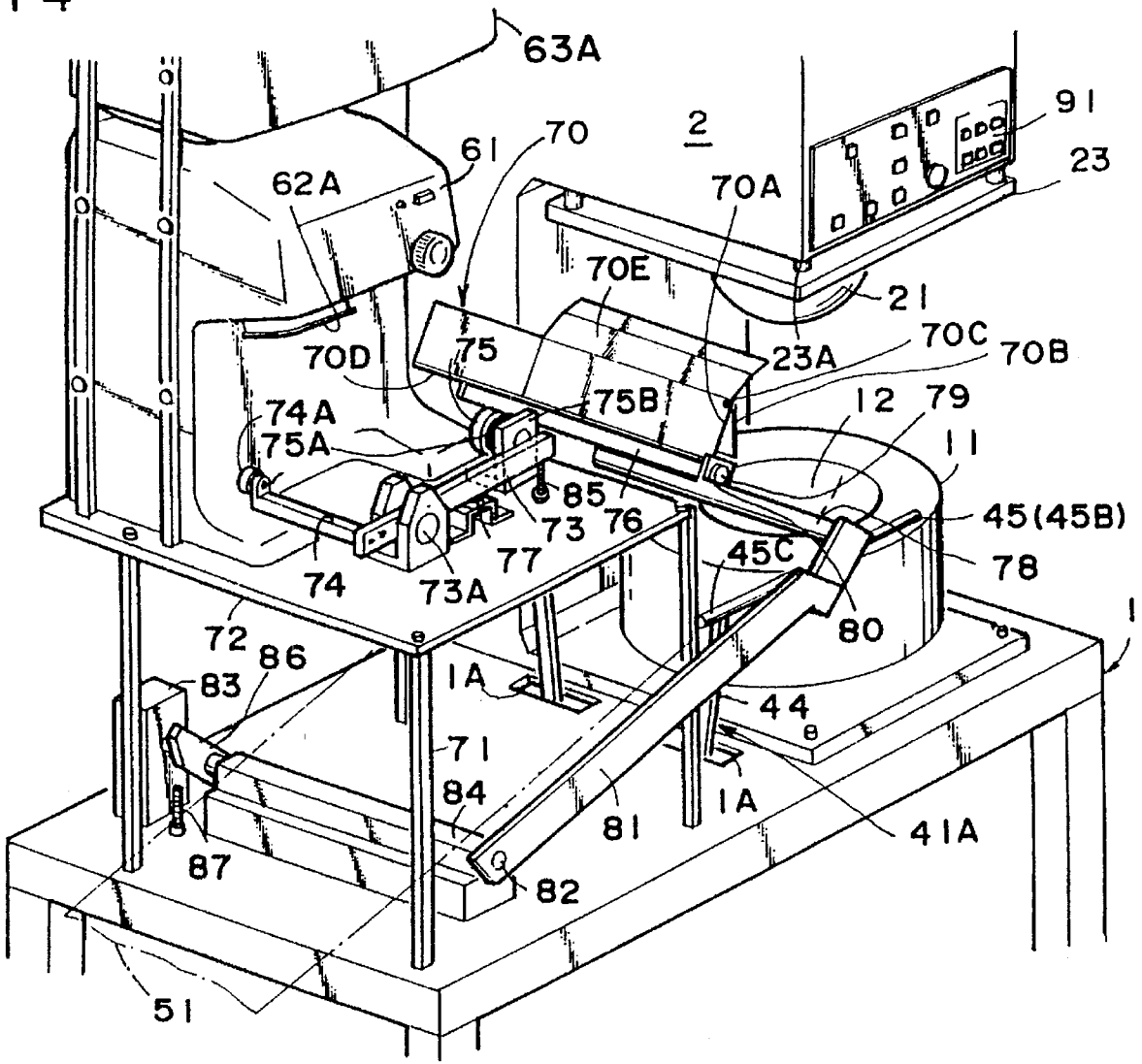
FIG. 14 is a perspective view showing a chute box in an inclined state of a second embodiment of the invention.
Figure 15:
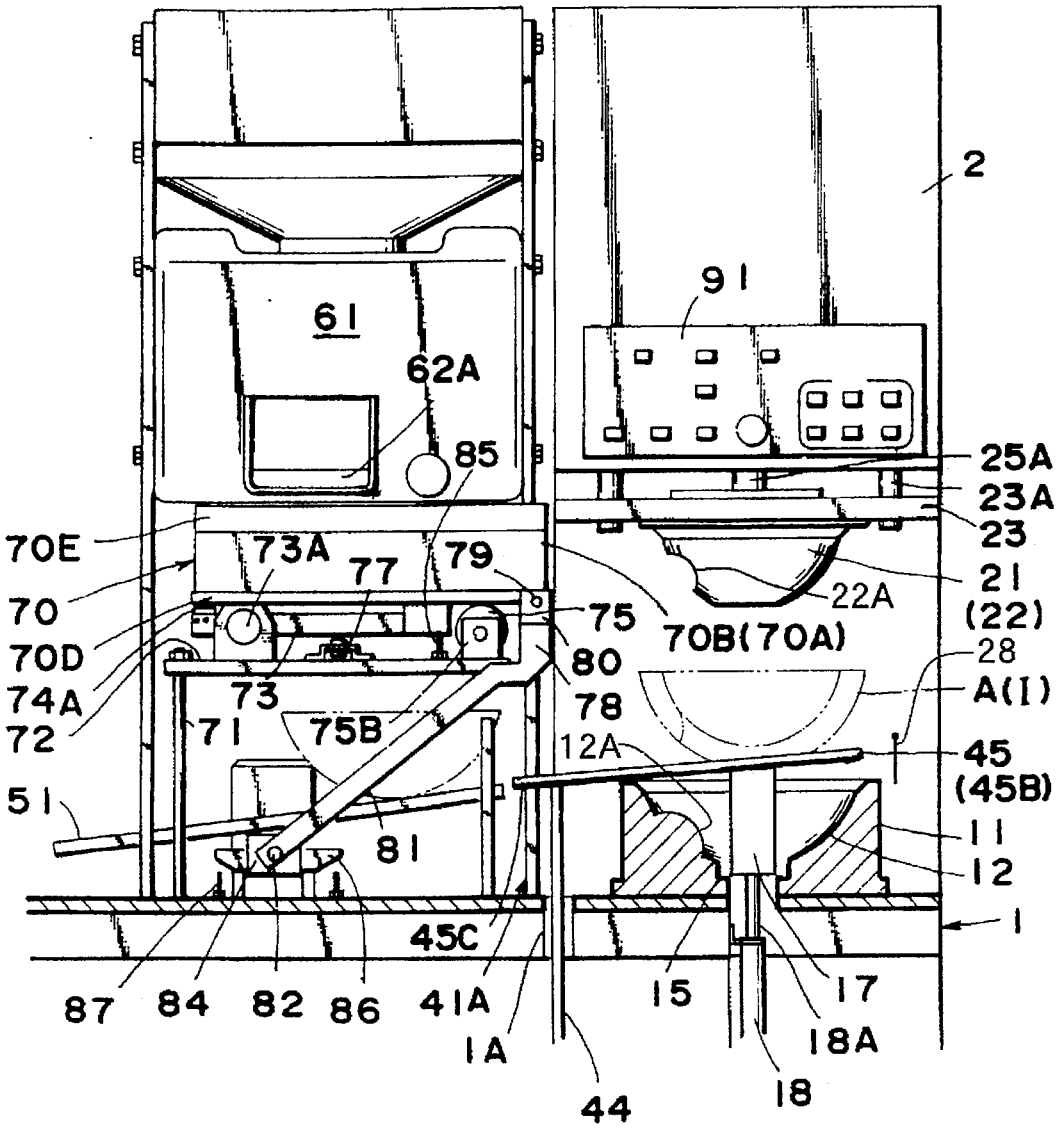
FIG. 15 is a section showing a second embodiment of the invention.
Figure 16:
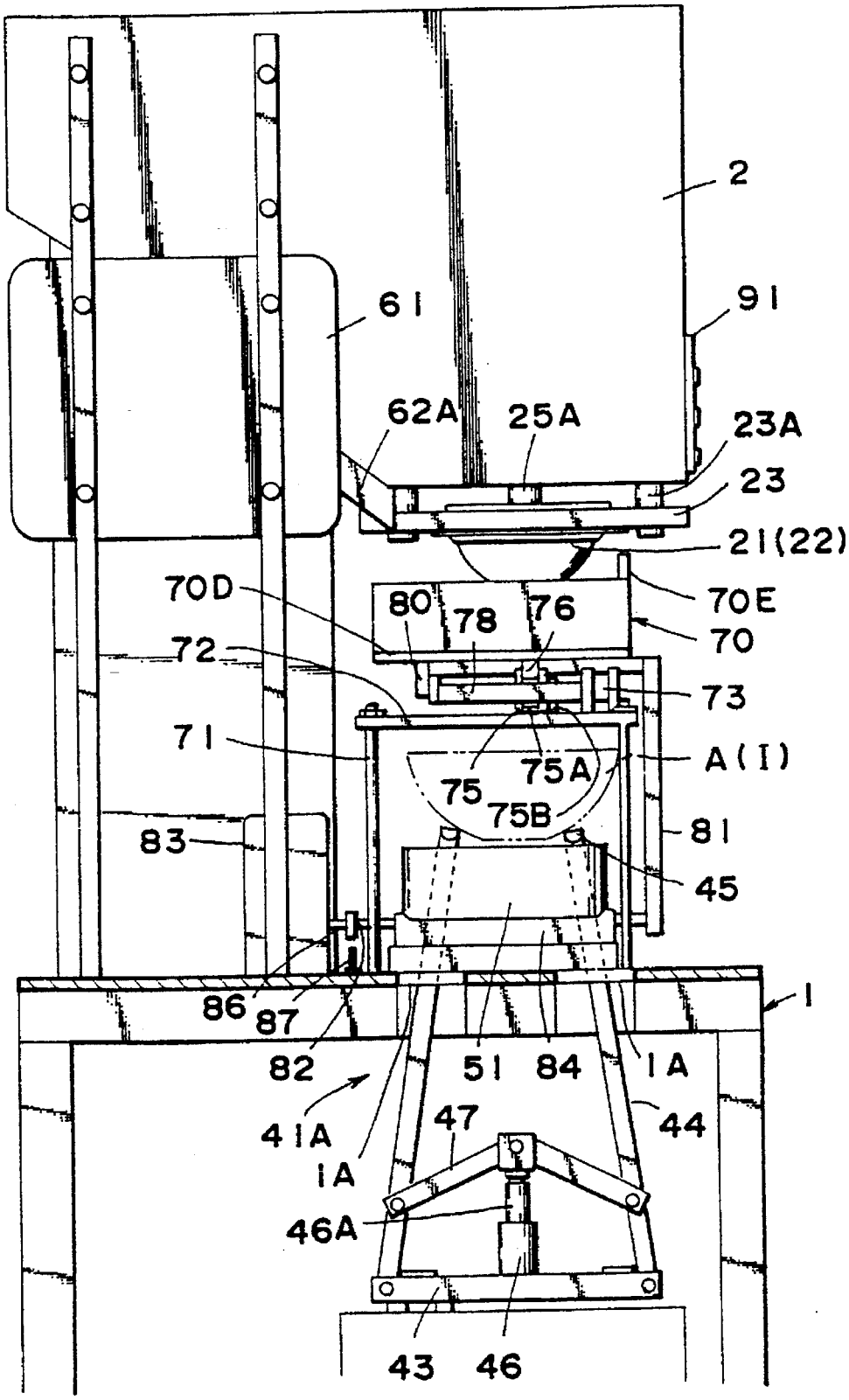
FIG. 16 is a side view showing a second embodiment of the invention.

In FIGS. 11 and 12 illustrating ice making machinery 63 for supplying the automatic ice crusher 61 with ice masses, the machinery 63 comprises water cooler 64, ice making box 65 and refrigeration unit 66. The cooler 64 disposed above has a refrigerating machine (not shown) and holds constant a water level of water supplied from water pipe 64A and keep the same cold, preferably within a range from 0 to 4 degs centigrade, having supply port 64B having automatic closing valve 64C, thus providing feed-water line for the ice making box 65, which has an upper aperture 65A opposite to the supply port 64B to receive the cold water. To a periphery of the ice making box 65 is secured evaporator 67 formed from a meandering pipe, which is connected to the refrigeration unit 66 across flexible pipe 66A. The refrigeration unit 66 has built-in motor-driven compressor 66A and condensor 66B. At a bottom of the ice making box 65 is slidably provided pushing-out pin 68, which is provided with pneumatic or hydraulic cylinder 69 mounted on a lower surface of the bottom, having rod 69A which penetrates through the bottom of the ice making box 65 to connect to the pushing-out pin 68. An inner surface of the ice making box 65 and a surface of the pushing-out pin 68 are each coated with fluororesin layer (not shown), while around a peripheral surface of the pin 68 is provided O-ring 68A for watertight purpose, said pin 68 having its upper surface 68B inclined. In addition, there is provided guide plate 61B for guiding ice masses from the upper aperture 65A to inlet 61A of the automatic ice crusher 61. Reference numeral 63A designates heat insulating chamber.

Hereinafter is described an action of the above-described structure. When a starting switch (not shown) of operation panel 91 is actuated, the reciprocating body 17 vertically rises within the concave portion 12 of the female die 11, as shown in FIG. 7(A). The height of the body 17 is predetermined so as to be half as long as the depth of the concave portion, but not to exceed the upper edge of the female die 11.

Whilst, the ice making machinery 63 is actuated in advance for storage of cold water in the water cooler 64. The actuation of the starting switch allows the automatic closing valve 64C to open, thus feeding the cold water into the ice making box 65. At that time, the pin 68 is lowered, while the volume of the fed cold water corresponds to that required to produce a single ice vessel A hereinbelow described. The automatic closing valve 64 opens during a certain time preset by a timer (not shown) buit in the operation panel 91.

Then, the cold water accommodated into the ice making box 65 is further cooled by the evaporator 67. In other words, refrigerant such as freon or freon substitute is evaporated within the evaporator 67 to deprive the ice making box 65 of heat, thereby transforming the cold water into block-shaped ices. The refrigerant of the evaporator 67 is compressed by the compressor 66A, and then, liquidized due to outgoing radiation in the condensor 66B. The liquidized refrigerant is then delivered to the evaporator 67 again, then circulates in the same manner.

After ice masses are produced in the above described manner, the cylinder 69 is actuated to raise the pushing-out pin 68 until its inclined upper surface 68B slightly protrudes from the upper aperture 65A, whereby the ice masses are pushed out still upward relative to the upper aperture 65A so that they intermittently fall into the inlet 61A, sliding on the guide plate 61B. The production of the ice masses and the intermittent supply of ice pieces by the automatic ice crusher 61 are each synchronized to a production cycle of an ice vessel A, by control of the automatic closing valve 64C and the cylinder 69. For example, a position detector switch (not shown) is provided so as to be turned on in response to the movement of the carrier arm device 41, thereby detecting the conveyance of molded ice vessel to link each operation of automatic closing valve 64C, cylinder 69 and automatic ice crusher 61 through sequence circuit (not shown) of operation panel 91.

In the above-described manner, ice masses fed into automatic ice crusher 61 are crushed to be about 2 or 5 mm-sized ice pieces, and then, from the outlet chute 62 are fed ice pieces I into the chute box 31. After the ice pieces I are accommodated into the chute box 31 one after another, the chute box 31 is rotated anti-clockwise around the shaft 3B together with the slide plate 31A due to the weight of the ice pieces I. Therefore, the slide plate 31A is lifted up to raise the elevator rod 37, thus allowing the lever 38 to rotate clockwise for the turning on of the switch 40. Briefly explaining this operating system, switch 40 will not be turned on while the weight of ice pieces in chute box 31 remains comparatively light, but will be turned on when the weight reaches a predetermined level, which can be understood in view of the balance of the moment on the side of slide plate 31A and the moment on the side of lever 38 having balance weight 39.

When switch 40 is turned on, cylinder device 34 starts to extend rod 34A so that chute box 31 moves forward together with slide plate 31A until the lower end of outlet 32 is positioned above the concave portion 12 of female die 11. Thereafter, gate plate 33 is opened to thickly accommodate ice pieces I into the female die 11. Thereafter gate plate 33 is closed by cylinder device 34 actuated by a timer (not shown) or the like, and chute box 31 moves backward to be supplied with a new predetermined amount of ice pieces I in preparation for the next production of an ice vessel.

Subsequently, pneumatic cylinder device 30, as shown in FIG. 6, is actuated to extend rod 30A in order that ice pieces equalizer 28 may slide on heaped-up ice pieces I (see FIG. 8(A) and (B)). At this time, ice pieces equalizer 28 moves outwardly with the same inclined at angle Y to remove a part of ice pieces I, then returns with the same inclined at angle X to further remove surplus amount of ice pieces I protruding from the upper surface of female die 11, thus filling the concave portion 12 with ice pieces I up to the volume thereof at most.

Thereafter, pneumatic cylinder device 18 contracts its rod 18A so that reciprocating body 17 is withdrawn toward the bottom of semispherical concave portion 12 (see FIG. 9(A)), whereby the center portion of the ice pieces I accommodated in concave portion 12 can be formed with sinking S. Consequently, the section of the ice pieces I in the concave portion 12 will be approximately U-shaped, thereby ensuring neary equal thickness of ice pieces layer. Incidentally, the volume of the sinking S is approximately equal to that of reciprocating body 17.

The male die 21 is then lowered to the position of switch 27 for detecting the lower elevating limit of male die 21, by extending rod 25A of cylinder device 25 until the convex portion 22 is fitted into concave portion 12. The ice pieces in the concave portion 12 are thereby depressed to be formed into a hemispherically shaped ice vessel A (see FIG. 10(B)).

Figure 9:
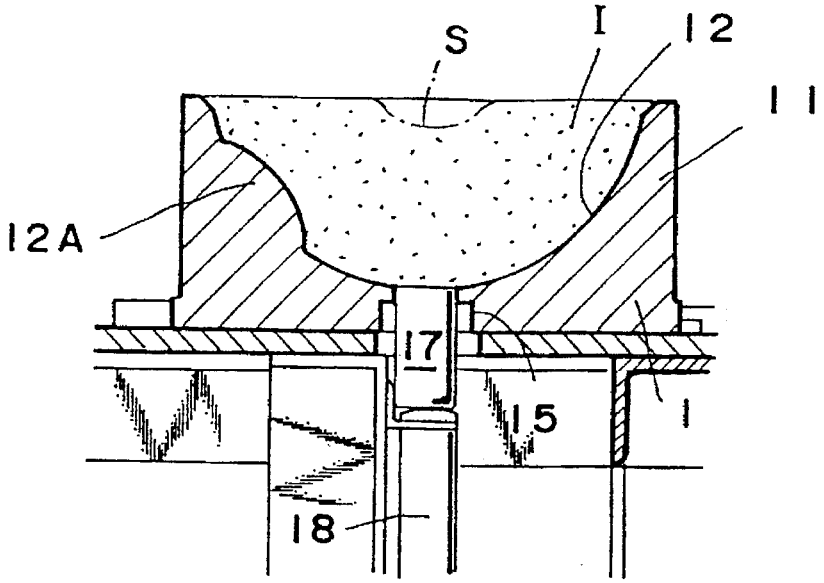
Figure 9:
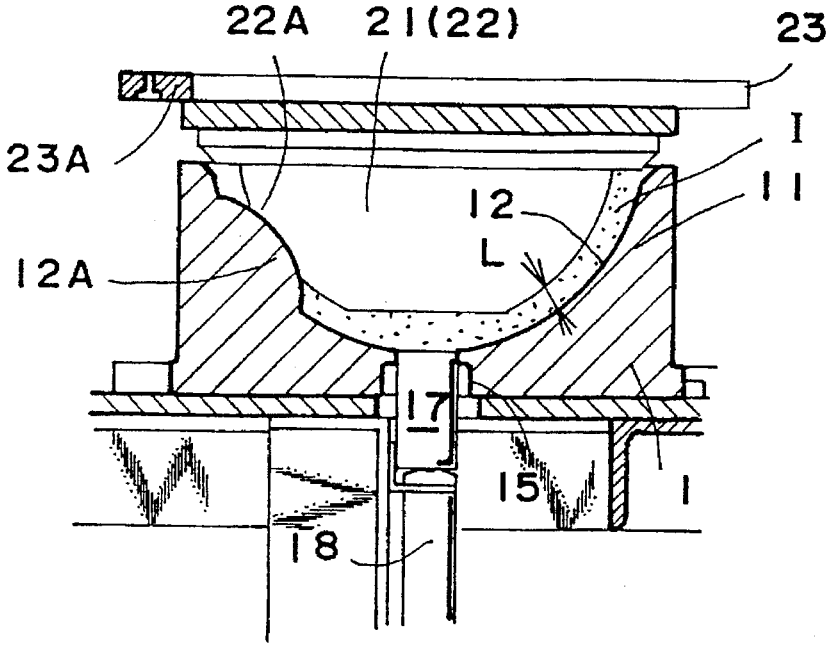

After that, rod 25A is extended by cylinder device 25 in order to lower the male die 21 down to the lower elevation limit switch 27, thus fitting the convex portion 22 into the concave portion 12 to mold an ice vessel A (see FIG. 9 (B)).

Figure 10:
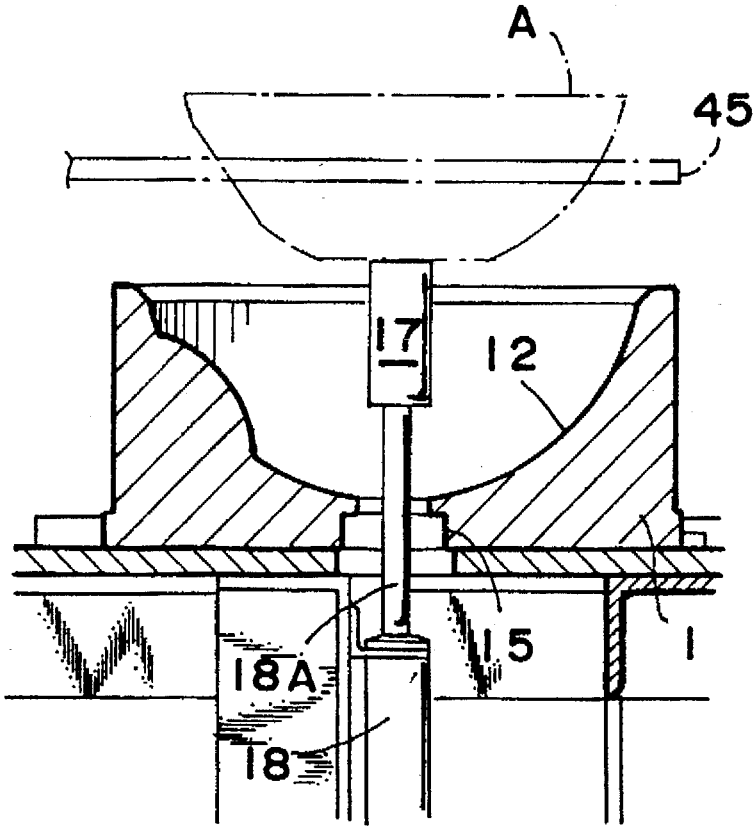
FIG. 10 is a section illustrating the seventh working process of a first embodiment of the invention.

After producing ice vessel A in the above-described manner, rod 25A is contracted to raise male die 21 up to the position of switch 26 for detecting the upper elevating limit of male die 21. Thereafter, rod 18A is extended by cylinder device 18 in order to raise reciprocating body 17 up to the upper edge surface of female die 11, thereby allowing a molded ice vessel A to be lifted up, with the same carried on the body 17, as shown in FIG. 10. While the ice vessel A is raised in this manner, rod 42A is retrieved by cylinder device 42, so that laterally paired holding arms 45 are positioned beside both sides of the bottom portition of the ice vessel A.

In this case, as rod 46A is extended by cylinder device 46, the distance between the two pendulous arms 44 linked by interlocking arm 47 is generally decreased. Consequently, the distance between the two lower ends of the laterally paidred holding arms 45 becomes narrower than the length corresponding to the diameter of said ice vessel A. Then rod 18A is lowered by cylinder device 18 together with said ice vessel A, which is to be positioned onto said paired holding arms 45. Thereafter, rod 42A is extended by cylinder device 42 until the holding arms 45 and pendulous arms 44 are positioned in the upper end of outlet chute 51. Rod 46A is then raised by cylinder device 46 to widen the distance between the two holding arms 45, so that ice vessel A falls down for a short distance to be placed on the outlet chute 51. Thereafter, the ice vessel A is transported, sliding along the slope of the outlet chute 51, to be presented as a dish for vegetable salad or raw food such as "SASHIMI".

According to a first embodiment of the invention, there is provided a method for producing ice vessel with the use of an apparatus for producing ice vessel comprising a female die 11, a male die 21 opposite to said female die; a through-hole 15 formed at the bottom of said female die 11; a reciprocating body 17 which is raised or lowered in said through-hole 15 by a pneumatic cylinder device 18; a chute box 31 for feeding ice pieces from suitable ice crusher into said female die 11, of which the steps comprising: feeding ice pieces I from the chute box 31 into the female die 11 with the reciprocating body 17 being raised to protrude from a bottom surface of the female die 11; pressing the male die 21 to the female die 11 to mold an ice vessel with the reciprocating body 17 being lowered, thereby forming a sinking S prior to pressing the male die 21 to the female die 11 owing to the withdrawal of the reciprocating body 17, so that each of the molded ice vessels A can have a uniform thickness L.

Further, as there are provided three set-positions of the reciprocating body 17 such as an intemediate position in feeding ice pieces I to form the sinking S in the accumulated ice pieces I prior to molding, a lower position in molding the ice vessel A where the upper surface of the body 17 is on the same plane relative to the bottom surface of the concave portion 12 and an upper position in lifting up the molded ice vessel A to take out the same, molded ice vessel A can be very easily taken out. Furthermore, the above three positions of the body 17 can be switched by the single pneumatic cylinder device 18, the apparatus can be compacted as a whole.

In addition, as there is provided the ice pieces equalizer 28 which is slidable on the upper surface of the accumulated ice pieces above the female die 11, the surplus amount of the ice pieces I which are fed from the chute box 31 and heaped up in the female die 11 can be successfully removed, thus enabling the pressing of the male die 21 to the female die 11 to mold ice vessel A of a uniform thickness. In this case, as the ice pieces equalizer 28 removes a part of the accumulated ice pieces I with the same inclined at angle Y during its approach trip, while it removes the remaining surplus ice pieces I with the same inclined at angle X during its return trip, thus ensuring the removing of the surplus amount of ice pieces I through multiple removing processes.

Seen from another aspect of a first embodiment of the invention, there is provided in this embodiment an apparatus for producing ice vessel which comprises: an ice making machine 63 which comprises an ice making box 65 having a cold water supply port 64B. An evaporator 67 provided in the ice making box 65, a refrigerant compressor 66A and condensor 66B connected to the evaporator 67 and an ice pieces pushing-out pin 68; an automatic ice crusher 61; a female die 11 for accommodating the crushed ice pieces; an elevatable male die 21 opposite to the female die 11, whereby the ice making box 65 having cold water accommodated therein can be directly cooled to intermittently produce ice masses, so that the production of ice vessels A can be quickly started.

Specifically, as the volume of the ice making box 65 corresponds to that for required when producing one ice vessel A, the ice-making, crushing, molding and transporting can be carried out in sequence per a unit quantity for making ice, thereby efficiently making ice. Further, as the pushing-out pin 68 has the inclined upper surface 68B, most of ice masses protruding from the upper aperture 65A can be successfully fed into inlet 61A of automatic ice crusher 61 through guide plate 61B.

Hereinafter is described a second embodiment of the invention with reference to FIGS. 13 to 16, wherein the same portions as those described in a first embodiment will be designated as common reference numerals, and their repeated detailed description will be omitted.

To base frame 1 is fixed female die 11, opposite to which is provided male die 21, which is vertically movable. At one side between male die 11 and female die 21 is provided chute box 70 for feeding ice pieces I into female die 11, while at its other side is provided carrier arm 41A for transporting molded ice vessels. Adjacent the carrier arm device 41A is provided inclined transporting chute 51.

An upper surface of the female die 11 is formed with semispherical concave portion 12. At the lowest part of the concave portion 12 is vertically provided through-hole 15, in which is provided cylindrical reciprocating body 17, having pneumatic cylinder device 18 therebelow as an elevator device.

An lower surface of the male die 21 is formed with semispherical convex portion 22. Onto upper frame 2 provided above the base 1 is secured pneumatic cylinder device (not shown) directed vertically downward, having rod 25A connected to the male die 21. The actuation of the cylinder device 25 can allow the male die 21 to press toward the female die 11.

The chute box 70 is a rectangular box, having an upper aperture as an inlet port and side-door 70B as an outlet port 70A. The side-door 70B has pivot 70C in the upper portion. At the front part of the chute box 70 is erected block wall 70E such that the block wall 70E is positioned opposite to supply port 62A of automatic ice crusher 61. The chute box 70 is mounted on horizontal plate 72 which is fixed and supported by legs 71 above the base frame 1. Approximately in the middle of the front part of the horizontal plate 72 is mounted lever 73, which is reciprocatively moved up and down with respect to fulcrum shaft 73A. Half crossed rod 74 is connected to the end of the lever 73 such that they are orthogonal to each other. To the end of the half crossed rod 74 is mounted roller 74A so that bottom plate 70D of said chute box 70 may slide. In the middle of said horizontal plate 72 is axially horizontally provided roller 75 having grooves 75A around the periphery thereof. The roller 75 is rotatably mounted to mounting seat 75B, so that bar 76 secured in the center of bottom plate 70D of the chute box 70 is capable of sliding on the grooves 75A.

On the horizontal plate 72 is mounted proximity detector 77 facing the middle position between fulcrum shaft 73A and roller 75 to detect the position of the chute box 70. The switch of said proximity detector 77 is not depressed by lever 73 while chute box 70 is kept horizontal without predetermined amount of ice pieces I in said chute box 70.

On the other hand, the switch thereof is depressed by lever 73 either when chute box 70 is filled with a predetermined amount of ice pieces I, or after it is filled with a predetermined amount thereof at the side near t6 female die 11.

Along the lower edge of outlet port 70A of the chute box 70 is provided rod 78 to drive the chute box 70 back and forth, and projecting piece 80 of the rod 78 is rotatably connected to shaft 79 on both sides of outlet port 70A of said chute box 70. To the end of rod 78 is connected the upper end of rocking arm 81 provided obliquely above the front part of the base frame 1. With the lower end of said rocking arm 81 is linked one end of rotation shaft 82 in a right-angled manner. With the other end of the rotation shaft 82 is connected pneumatic cylinder device 83 provided for rotation drive. To support the rotation shaft 82 is provided supporting member 84, which is rotatably penetrated by the rotation shaft 82. Additionally, stop 85 for height control is screwed into the end of the lever 73, and a pair of opposite stops 87, also for height control, are screwed from both sides of projecting piece 86, which is fixed to one of the ends of the rotation shaft 82 nearer to the cylinder device 83, into the base frame 1.

The actuation of said pneumatic cylinder device 83 allows the angle of elevation of the rocking arm 81 to change from nearly 35 degrees to nearly 10 degrees. The arm 81 is to be returned to the initial position and the process is to be repeated by controlling the pneumatic cylinder device 83. Where necessary, to the lever 73 may be mounted a balance weight (not shown).

The structure of the carrier arm 41A is shown as an inverted form of the carrier arm 41 described in the first embodiment, wherein the lower ends of pendulous arms 44 positioned fore and aft penetrate through holes 1A formed in the base frame 1. To the upper ends of the pendulous arms 44 are connected holding arms 45 extending toward the female die 11 respectively. The holding arms 45 are obliquely provided so that one end 45B of each holding arm 45 is kept higher than the other end 45C which leads to the transporting outlet chute 51. In order to move the pendulous arms 44 toward and away from each other, pneumatic cylinder device 46 is perpendicularly mounted on the frame 43 with its rod 46A rotatably connected to one end of each of the interlocking arms 47, and the other end of each rotatably connected to the pendulous arms 44, respectively.

Automatic ice crusher 61 is placed in the back part of said horizontal plate 72 so as to supply said chute box 70 with ice pieces I. The ice supply port 62A of the automatic ice crusher 61 is provided above the left part of the aperture of chute box 70.

Now the action of the apparatus having the described structure will be explained. The body 17 protrudes up to the intermediate position within concave portion 12 of female die 11. Then, ice pieces I are fed from the ice supply port 62A into the left part of chute box 70. Sequential filling of ice pieces I into the chute box 70 causes the weight in chute box 70 to generally increase. This causes chute box 70 to rotate clockwise around shaft 73B together with lever 73. Then, proximity detector 77 is actuated to detect the presence of sufficient ice pieces charged in chute box 70, so that the automatic ice crusher 61 stops supplying ice pieces I.

The actuation of the proximity detector 77 allows pneumatic cylinder 83 to work, which causes rotation shaft 82 to rotate together with rocking arm 81, so that chute box 70 is pulled out and inclined toward female die 11 with bar 76 sliding on roller 75. Consequently, door 70B is opened to feed ice pieces I from outlet port 70A into the hemispherical concave portion 12 of female die 11, thus accommodating ice pieces I in concave portion 12 with the same heaped up therein.

Thereafter, reverse actuation of said pneumatic cylinder device 83 allows the chute box 70 to return to the initial position. The proximity detector 77 detects the chute box 70 being empty so as to be fed with ice pieces I from ice supply port 62A in preparation for the next production run.

Subsequently, ice pieces equalizer 28 reciprocates to remove surplus amount of ice pieces I heaped up in concave portion 12 and pneumatic cylinder device 18 then contracts its rod 18A so that reciprocating body 17 is withdrawn toward the bottom of hemispherical concave portion 12, whereby the center portion of the ice pieces I accommodated in concave portion 12 can be formed with sinking S. Consequently, the section of the ice pieces I in the concave portion 12 will be approximately U-shaped, thereby ensuring neary equal thickness of ice pieces layer. The male die 21 is then lowered by extending rod 25A of cylinder device 25 to form the ice pieces I accommodated in concave portion 12 into an ice vessel A.

Thereafter, rod 25A is contracted to raise male die 21 and rod 18A is extended by cylinder device 18 in order to raise reciprocating body 17 up to the said upper position, thereby allowing a molded ice vessel A to be lifted up above female die 11. After that, rod 46A is extended by cylinder device 46, so that the distance between the holding arms 45 is generally decreased. Then, rod 18A is retrieved by cylinder device 18 so that the molded ice vessel A is carried on said holding arms 45. The carried ice vessel A is allowed to slide along the inclination of the holding arms 45 until it is carried on the outlet chute 51, then slides along the slope of the outlet chute 51 for transportation to a suitable place. The said holding arms 45 can be widened again in preparation for the next run.

Incidentally, pneumatic cylinders provided for driving sources in the foregoing embodiments may be replaced with electric motors.

Figure 17:
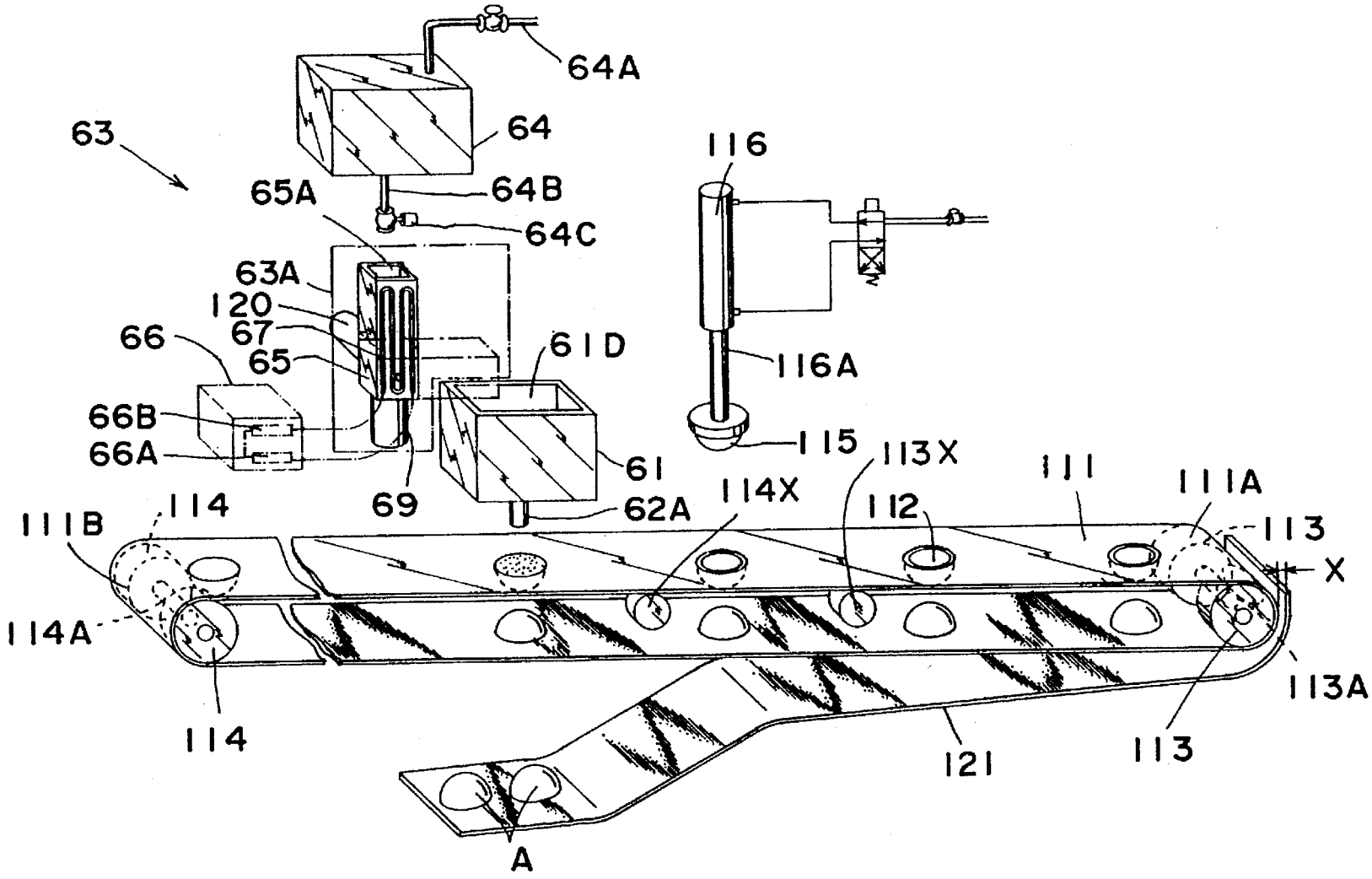
FIG. 17 is a perspective view showing a third embodiment of the invention.
Figure 18:
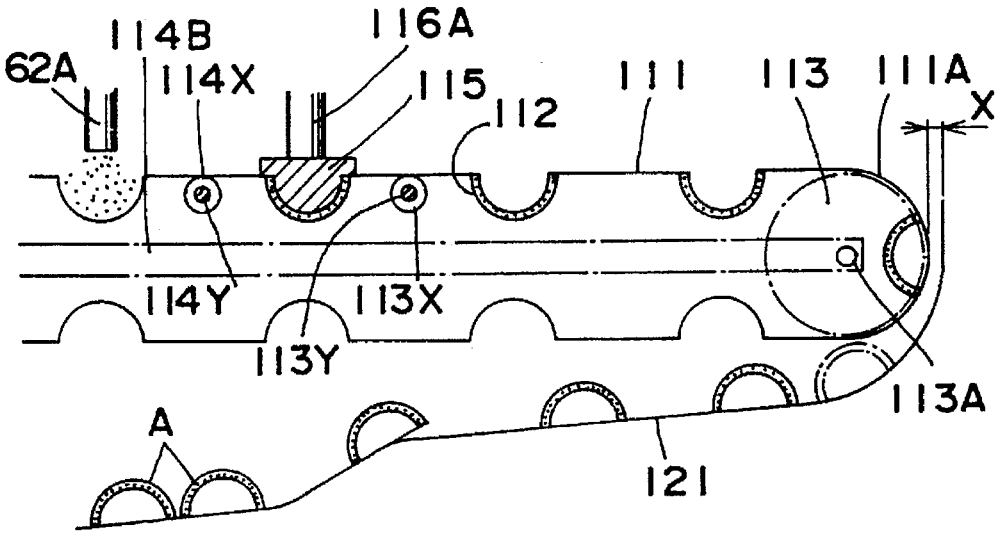
FIG. 18 is a section showing a third embodiment of the invention.
Figure 19:
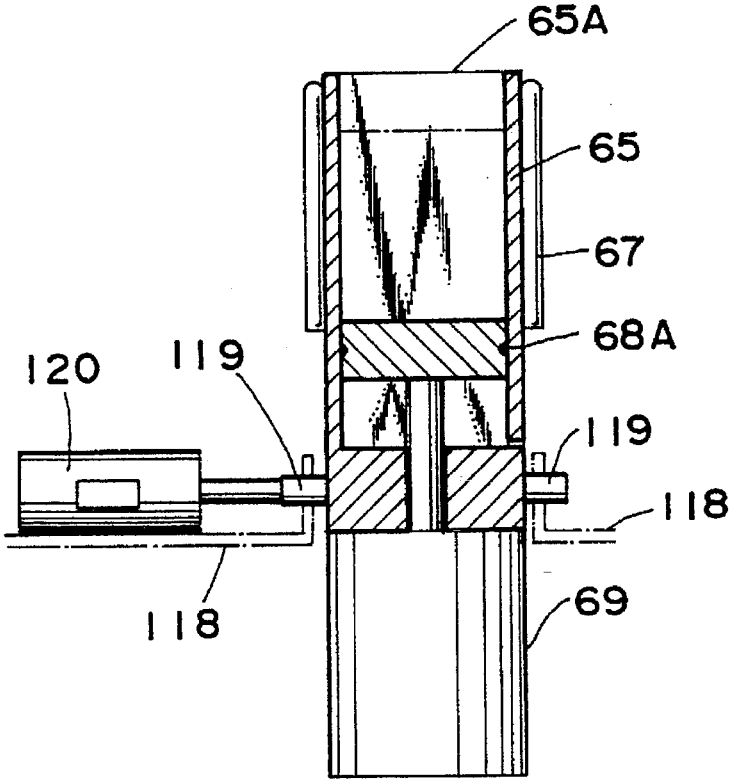
FIG. 19 is a section showing an ice making box of a third embodiment of the invention.

In FIGS. 17 to 19 showing a third embodiment of the invention, the same portions as those described in the foregoing embodiments are designated as common reference numerals.

In a third embodiment, reference numeral 111 designates endless conveyor made of flexible resin or rubber such as elastomer or the like. The surface of conveyor 111 is spacedly formed with a plurality of hemispherical concave portions to form female dies 112 for molding ice vessels A respectively. There is provided driving roller 113 driven by a motor (not shown) at one side of the conveyor 111, while driven roller 114 at the other side thereof. These rollers 113 and 114 have shafts 113A and 114A connected thereto in the centers thereof respectively, which are rotatably supported by frame 114B. Reference numerals 113X and 114X designate guide rollers respectively, each having shaft 113Y or 114Y connected to frame 114B.

Reference numeral 115 is hemispherical male die which is positioned a little to initial station side 111B away from terminal side 111A of endless conveyor 111. The male die 115 is connected to rod 116A of pneumatic or hydraulic cylinder device 116 provided for an elevator device. The cylinder device 116 is switched by electromagnetic valve 117 to raise or lower the male die 115. Outlet chute 62A of automatic ice crusher 61 is provided for ice making machine 63, being positioned near the initial station side 111B away from male die 115. The interval between the male die 115 and the outlet chute 62A is set equal to that between each female die 112 or integer times thereof. Ice making box 65 provided in ice making machine 63 is rotatably mounted via shaft 119 to frame 118, said shaft 119 being connected to motor 120 so that ice making box 65 can be inclined from its erected position until the upper aperture 65A thereof obliquely faces the inlet port 61D of automatic ice crusher 61.

Reference numeral 121 designates collecting plate for collection of the molded ice vessels A which is provided at terminal station side 111A of conveyor 111. The distance X between the conveyor 111 and the collecting plate 121 is relatively small at terminal side 111A, which generally increases toward the other side. The automatic closing valve 64C, refrigerating unit 66, electromagnetic valve 117, motor 120 and another motor for driving roller 113 are each controlled by a suitable controller device.

Now the action of the apparatus having the described structure will be explained.

The actuation of the controller device (not shown) allows cold water to be supplied from water cooler 64 to ice making machine 65 in the erected position with a quantity thereof being adjusted by automatic closing valve 64C controlled by a timer (not shown). The cold water is then further cooled within ice making box 65 to produce ice masses. Thereafter, motor 120 is actuated to allow ice making box 65 to incline toward ice crusher 61, while cylinder device 69 is worked to raise pushing-out pin 68 slightly above upper aperture 65A. Thus, the ice masses are pushed out to be fed into inlet port 61D, which are then crushed by automatic ice crusher 61, thereby allowing the obtained ice pieces to be accommodated through outlet chute 62A into female die 112.

When intermittent movement of endless conveyor 111 permits one of the female dies to face the male die 115, cylinder device 116 is actuated by electromagnetic valve 117 to lower male die 115 until it is depressed to female die 112, thereby forming the ice pieces within female die 112 into an ice dish. After that, male die 115 is raised by cylinder device 116, while endless conveyor 111 intermittently moves forward until the female die 112 arrives at terminal station 111A where endless conveyor is arc-shaped. Accordingly, the molded ice vessel A is removed from female die 112, and carried on collecting plate 121, which is inclined so that the ice vessel A can be shifted to other side for storage, as shown in FIG. 17.

According to a third embodiment of the invention, there is provided an apparatus for producing ice vessel, comprising an endless conveyor 111 having a plurality of female dies 112, an automatic ice crusher 61 having an outlet chute 62A opposite to one of the female dies 112, an elevatable male die 115 opposite to another female die 112, said conveyor 111 being intermittently moved while ice pieces are fed from outlet chute 62A into each female die 112, thus allowing male die 115 to be depressed to each female die 112 to successively mold ice vessels A.

Seen from another aspect of the invention, there is provided an apparatus for producing ice vessel, comprising an ice making machine 63 which comprises: an ice making box 65 having a cold water supply port 64B. An evaporator 67 provided in the ice making box 65, a refrigerant compressor 66A and condensor 66B connected to the evaporator 67 and a ice pieces pushing-out pin 68; an automatic ice crusher 61 for crushing ice masses supplied from the ice making machine 63; a plurality of female dies 112 for accommodating ice pieces from the ice crusher 61; an elevatable male die 115 opposite to one of the female dies 112, whereby the ice making box 65 having cold water accommodated therein can be directly cooled to intermittently produce ice masses, so that the production of ice vessels A can be quickly started.

Specifically, as the volume of the ice making box 65 corresponds to that for required when producing one ice vessel A, the ice-making, crushing, molding and transporting of ice vessels can be carried out in sequence per a unit quantity for making ice, thereby efficiently making ice. Further, as the pushing-out pin 68 has the inclined upper surface 68B, most of ice masses protruding from the upper aperture 65A can be successfully fed into inlet 61A of automatic ice crusher 61 through guide plate 61B.

In FIGS. 20 to 23 showing a fourth embodiment of the invention, the same portions as those described in the foregoing embodiments will be designated as common reference numerals, and their repeated detailed descriptions will be omitted.

In a fourth embodiment, there is provided rotary plate 131 of a large diameter which is positioned above terminal station 111A side of endless conveyor 111 having plural female dies 112. The rotation plate 131 has a plurality of male dies 115 integral therewith around its outer periphery. Each interval between the female dies 112 is set equal to each arc length between the male dies 115 on the rotary plate 131. A motor for drive of driving roller 113 and another motor for drive of rotary plate 131 are each so controlled that male dies 115 are fitted into the female dies 112 in sequence.

The actuation of the controller device (not shown) allows cold water to be supplied from water cooler 64 to ice making machine 65 in the erected position with a quantity thereof being adjusted to be nearly equal to that required for producing one ice vessel A by automatic closing valve 64C controlled by a timer (not shown). The cold water is then further cooled within ice making box 65 to produce ice masses. Thereafter, cylinder device 69 is worked to raise pushing-out pin 68 slightly above upper aperture 65A. Thus, the ice masses are pushed out to be fed into inlet port 61D, sliding along the slope of guide plate 61B, which are then crushed by automatic ice crusher 61, thereby allowing the obtained ice pieces to be accommodated through outlet chute 62A into female die 112.

Figure 20:
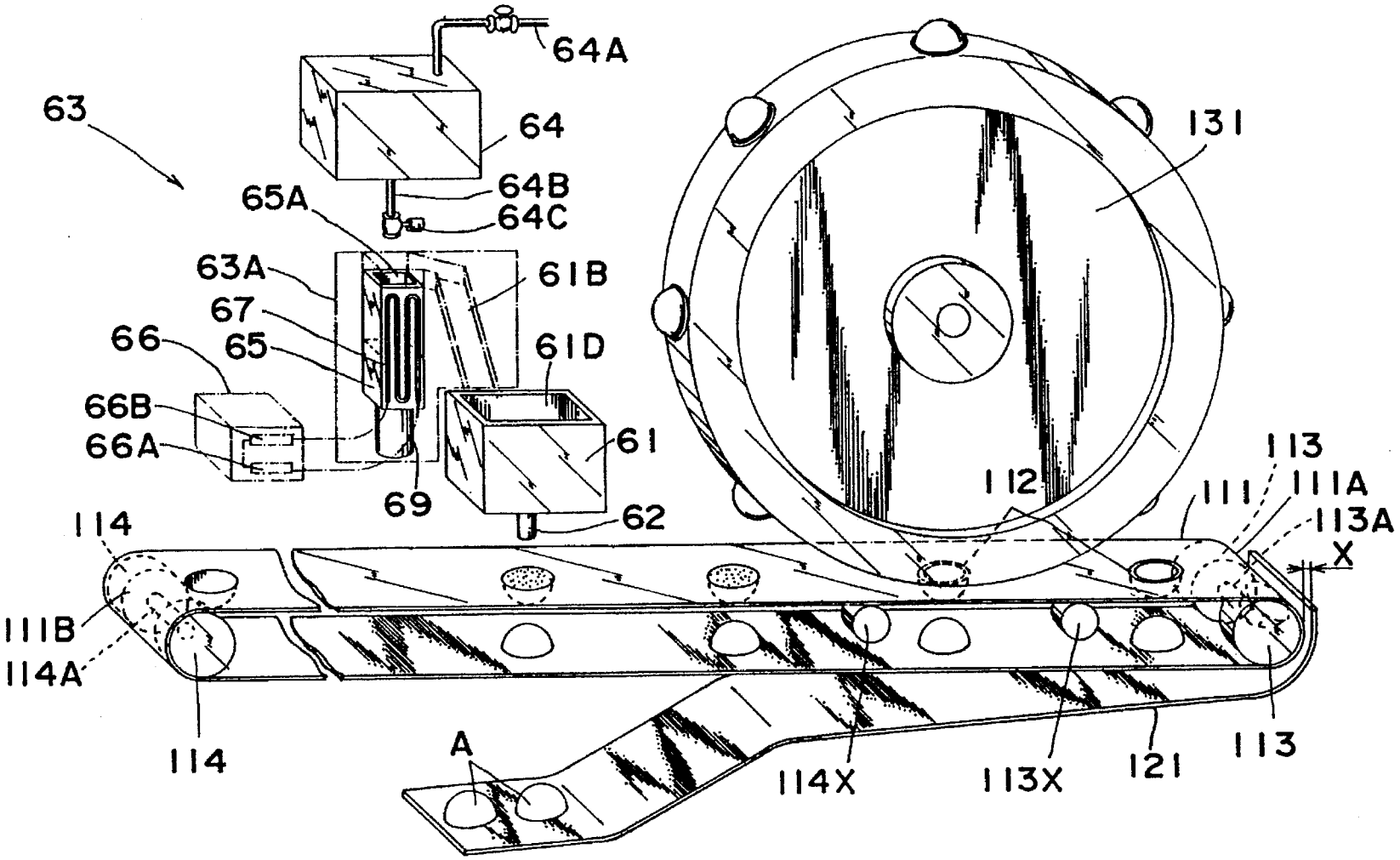
FIG. 20 is a perspective view showing a fourth embodiment of the invention.
Figure 21:
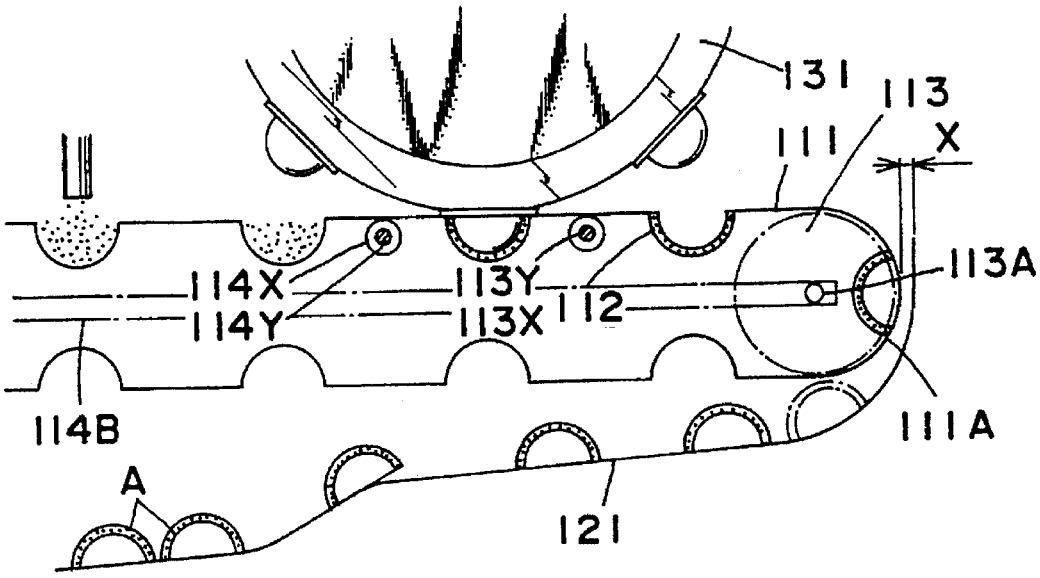
FIG. 21 is a section showing a fourth embodiment of the invention.
Figure 22:
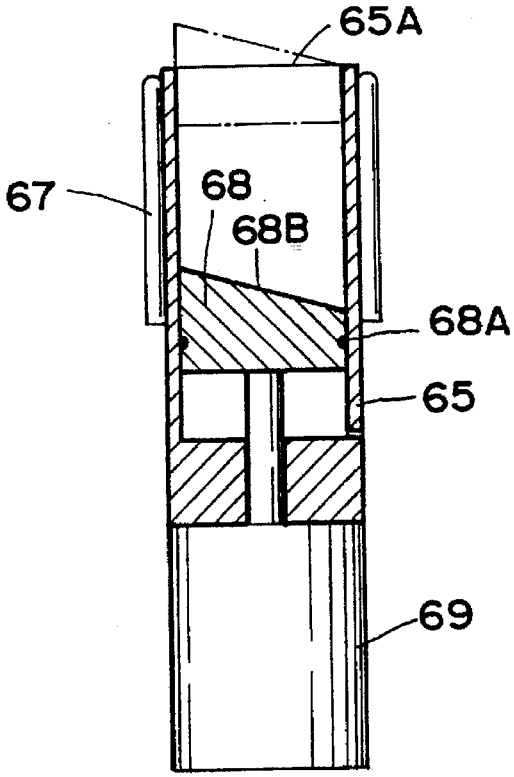
FIG. 22 is a section showing an ice making box of a fourth embodiment of the invention.
Figure 23:
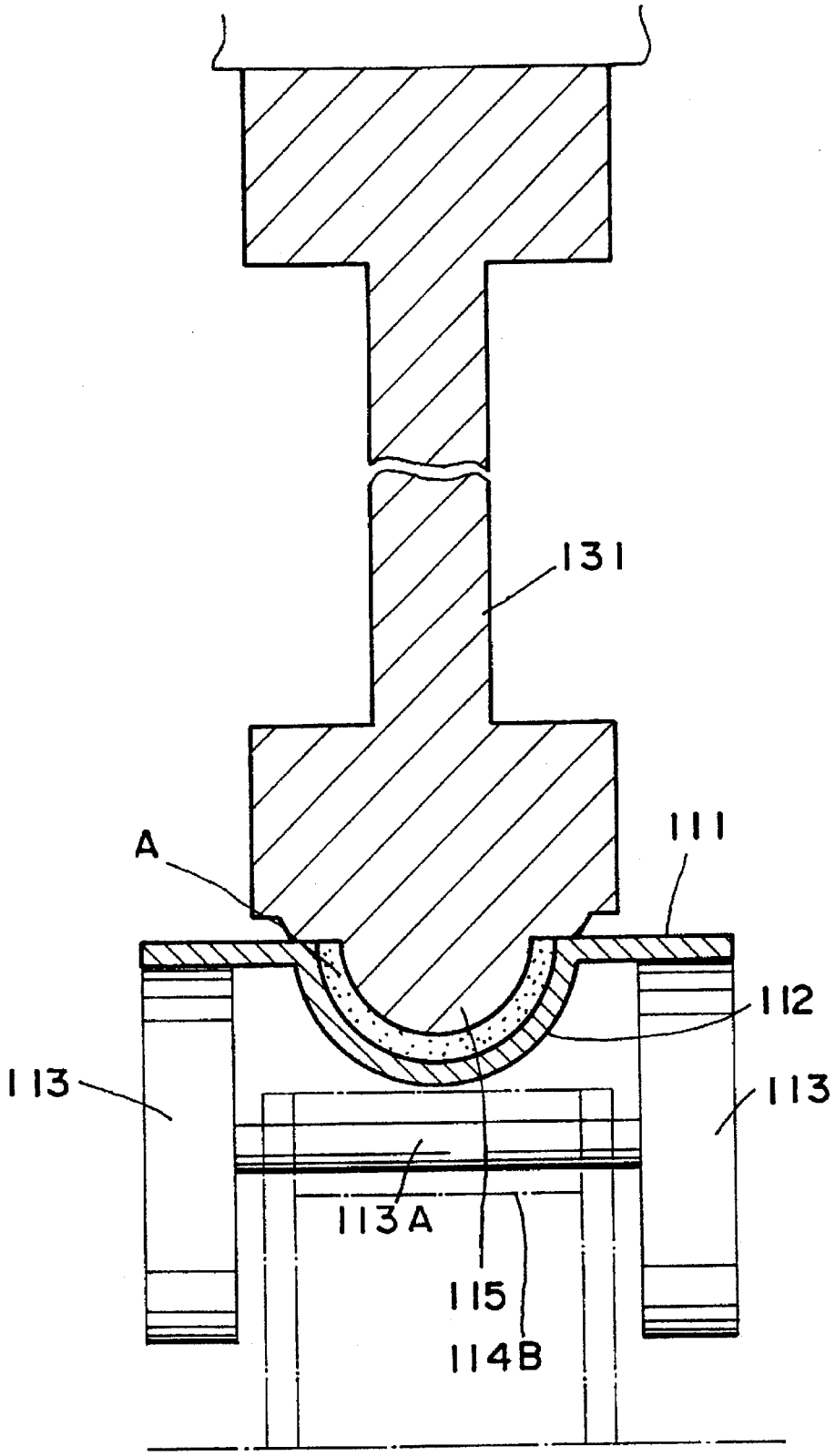
FIG. 23 is a section showing a rotary plate of a fourth embodiment of the invention.

With intermittent movement of endless conveyor 111 and rotation of rotary plate 131 associated therewith, male dies 115 are sequently fitted into female dies 112, thus forming the ice pieces within female die 112 into an ice dish. With further movement of endless conveyor 111 and further rotation of rotary plate 131, the fitted male dies 115 are separated from female dies 112. When the molded ice vessels A in the female dies 112 arrive at terminal station 111A where endless conveyor is arc-shaped, they are removed from female dies 112, and carried on collecting plate 121, which is inclined so that the ice vessels A can be shifted to other side for storage, as shown in FIG. 20.

According to a fourth embodiment of the invention, as there is provided the rotation plate 131 having plural male dies integral therewith around its periphery, ice vessels A can be successively produced with the movement of conveyor 111 and the rotation of rotation plate 131.

Incidentally, the present invention should not be limited to the foregoing embodiments, but can be modified within a scope of the invention. For example, ice vessels should not always be bowl-shaped, but may be tablar. The endless conveyor may be made of suitable metal such as stainless steel. Further, metallic female dies may be provided on a part of the endless conveyor for the benefit of improvement of durability. Furthermore, chute boxes 31 and 70 in the embodiments should not be limited to those shown therein, but optional boxes can be selected to suitably feed ice pieces.

What is claimed:

1. A method for producing ice vessels with the use of an apparatus for producing ice vessels having a female die, a male die opposite to said female die, a through-hole formed at the bottom of said female die, a reciprocating body which is raised or lowered in said through-hole by an elevator device and a chute box for feeding ice pieces from suitable ice crusher into said female die, of which the steps comprise:

feeding ice pieces from the chute box into the female die with said reciprocating body being raised to protrude from a bottom surface of the female die;

pressing the male die to the female die to mold an ice vessel with said reciprocating body being lowered.

2. The method of claim 1 wherein the apparatus for producing ice vessels further includes an ice making machine and an ice crusher and wherein the method of producing ice vessels further includes the preliminary steps of:

making ice in the ice making machine; and crushing ice by the ice crusher into ice pieces to then be fed from the chute box into the female die.

3. The method of claim 2 wherein the ice making machine further includes an ice making box and wherein the step of making ice further includes the step of making a volume of ice approximately equal to the capacity of the female die to hold ice.

4. The method of claim 3 wherein the ice making box further includes a refrigeration mechanism comprising an evaporator which is connected to a refrigerant condenser and compressor.

5. The method of claim 4 wherein the ice making machine is further provided with an ice pushing-out pin which is slidable up and down, said ice pushing-out pin being located downwards when producing ice then sliding upwards while pushing out the produced ice.

6. The method of claim 5 wherein an upper surface of the ice pushing-out pin is inclined, which pushes out the produced ice upward with its lower edge being positioned at nearly the same height as that of an upper aperture of said ice making machine, while allowing the produced ice to slide along the upper surface thereof to be delivered out therefrom.

7. A method for producing ice vessels with the use of an apparatus for producing ice vessels comprising a female die, a male die opposite to said female die, a through-hole formed at the bottom of said female die, a reciprocating body which is raised or lowered in said through-hole by an elevator device and a chute box for feeding ice pieces from suitable ice crusher into said female die, of which the steps comprise:

feeding ice pieces from the chute box into the female die with said reciprocating body being raised to protrude from a bottom surface of the female die;

removing surplus ice pieces by use of a equalizer which is slidable over the upper surface of the female die, pressing the male die to the female die to mold an ice vessel with said reciprocating body being lowered;

raising said reciprocating body again to lift up the molded ice vessel.

8. The method of claim 7 wherein the equalizer is connected to a slide-driving device and wherein the step of removing surplus ice pieces comprises the further steps of:

removing some surplus ice pieces on an approach trip; and removing remaining surplus ice pieces on a return trip.

9. The method of claim 7 wherein the upper end of the equalizer is rotatably connected to a shaft connected to a slide-driving device, the upper end of said equalizer being anchored to the shaft through a stopper at different angles and wherein the step of removing surplus ice pieces comprises the further steps of:

removing some surplus ice on an approach trip at a first inclined angle; and removing remaining surplus ice pieces on a return trip at a second inclined angle and wherein said inclined angles are prescribed so that a lower end of said equalizer is always delayed during the trips.

* * * * *